US008011700B2

(12) United States Patent
Ishiguro

(10) Patent No.: US 8,011,700 B2
(45) Date of Patent: Sep. 6, 2011

(54) DOOR LOCK SYSTEM

(75) Inventor: Katsuyuki Ishiguro, Yamanashi (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 999 days.

(21) Appl. No.: 11/896,856

(22) Filed: Sep. 6, 2007

(65) Prior Publication Data

US 2008/0078219 A1 Apr. 3, 2008

(30) Foreign Application Priority Data

Oct. 2, 2006 (JP) ..... 2006-271106

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS 4,904,006 A * 2/1990 Hayakawa et al. ..... 292/336.3
5,106,135 A * 4/1992 Menke et al. ..... 292/216
5,181,754 A * 1/1993 Shibata ..... 292/216
5,531,488 A * 7/1996 Yoshikuwa et al. ..... 292/216
5,803,515 A * 9/1998 Arabia et al. ..... 292/216
6,406,073 B1 * 6/2002 Watanabe ..... 292/216
7,021,681 B2 * 4/2006 Hayakawa et al. ..... 292/216
7,080,861 B2 * 7/2006 Watanabe ..... 292/216
7,293,806 B2 * 11/2007 Umino ..... 292/216
7,798,539 B2 * 9/2010 Hayakawa et al. ..... 292/216
2004/0036298 A1 * 2/2004 Hayakawa et al. ..... 292/216
2004/0113437 A1 6/2004 Hayakawa et al.

FOREIGN PATENT DOCUMENTS

JP 2004-137805 A 5/2004
JP 3574990 B2 7/2004

* cited by examiner

*Primary Examiner* — Carlos Lugo
(74) *Attorney, Agent, or Firm* — Foley & Lardner LLP

(57) ABSTRACT

A door lock system includes a ratchet, a latch, a ratchet lever that disengages the ratchet from the latch when a disengaging operation is performed, a first link lever that moves to and from a transmitting position and a non-transmitting position, wherein when the first link lever is at the transmitting position, the ratchet lever is allowed to disengage the ratchet from the latch, and when the first link lever is at the non-transmitting position, the ratchet lever is inhibited from disengaging the ratchet from the latch, a second link lever that is pivotally coupled to a base end of the first link lever at a base end of the second link lever and that moves in response to a locking operation and an unlocking operation. A distal end of the first link lever and a distal end of the second link lever constantly overlap each other.

4 Claims, 30 Drawing Sheets

DOOR LOCK SYSTEM

BACKGROUND OF THE INVENTION

1. Field of the Invention

The present invention relates to a door lock system for a vehicle.

2. Description of the Related Art

Vehicles such as a four-wheeled vehicle generally include a door lock system between an outside handle and a latch mechanism in a side door.

The latch mechanism includes a latch and a ratchet for engagement. When the side door is closed with respect to a vehicle body, the latch receives a striker provided on the vehicle body in a locking manner, and the ratchet engages with the latch to retain the striker in the locked state so that the side door is held in a closed state with respect to the vehicle body.

The door lock system includes a base plate. A handle lever shaft, a locking lever shaft, and a ratchet lever shaft are disposed on the base plate.

A handle lever is rotatably supported on the handle lever shaft. An outside-handle connecting member is disposed on an end of the handle lever to connect the handle lever to an outside handle. A handle lever spring is interposed between the handle lever and the base plate. A resilient force of the handle lever spring brings the handle lever into contact with a stopper on the base plate, thereby defining a non-operable position of the handle lever. The handle lever is rotated from the non-operable position to an operable position in response to, for instance, a door-opening operation performed by a driver using the outside handle.

A locking lever is rotatably supported on the locking lever shaft. A lock-knob connecting member is provided on an end of the locking lever to connect the locking lever to a lock knob (locking means). The lock knob is disposed in a cabin of the vehicle. Whereas operating the lock knob to unlock the door causes the locking lever to rotate from a locked position to an unlocked position, operating the lock knob to lock the door causes the locking lever to rotate from the unlocked position to the locked position.

A ratchet lever that includes a pressure-receiving portion is rotatably supported on the ratchet lever shaft and interlocked with the ratchet. The ratchet lever disengages the ratchet from the latch when the pressure-receiving portion receives pressure.

A link lever (second link lever) is interposed between the handle lever and the locking lever for coupling therebetween. The link lever is movable in response to rotation of the handle lever, and pivotable about a coupling portion between the link lever and the handle lever in response to rotation of the locking lever. A panic lever shaft (shaft member), on which a plate-like panic lever (first link lever) is rotatably provided, is disposed on the link lever.

The panic lever extends radially outward with respect to the axis of the panic lever shaft toward the pressure-receiving portion of the ratchet lever when the locking lever is in the unlocked position. The panic lever has a pressing portion (distal end) and a protrusion, and can press the pressure-receiving portion of the ratchet lever with the pressing portion. The protrusion protrudes from the plate-like front face of the panic lever. A notch for receiving a portion of the link lever is defined in the protrusion. When an unlocking operation is performed and the locking lever is moved from the locked position to the unlocked position, the panic lever is moved to a facing position (transmitting position) at which the pressing portion of the panic lever faces the pressure-receiving portion of the ratchet lever. On the other hand, when a locking operation is performed and the locking lever is moved from the unlocked position to the locked position, the pressing portion of the panic lever moves to a non-facing position (non-transmitting position) out of the transmitting position.

A panic spring (urging means) is interposed between the link lever and the panic lever. The panic spring constantly urges the first link lever toward the facing position.

The link lever is partially inserted into the notch in the panic lever, and the resilient force of the panic spring brings a side end of the link lever into contact with a deep end of the notch, thereby defining the facing position of the panic lever. Thus, the protrusion functions as a stopper that defines the facing position of the panic lever relative to the link lever. When the panic lever is at the facing position, the pressing portion is near a distal end of the link lever.

The door lock system operates such that, when the outside handle is operated in a direction to open the door with the handle lever moved to assume the non-operable position, the locking lever moved to assume the unlocked position, and the panic lever moved to assume the facing position (hereinafter, "unlocked state"), the link lever is moved via the handle lever in response to the door-opening operation such that the pressure-receiving portion of the ratchet lever comes into contact with the pressing portion of the panic lever. The movement of the link lever in turn causes the pressing portion of the panic lever to press the pressure-receiving portion of the ratchet lever, thereby disengaging the latch from the ratchet. Accordingly, even when the side door is closed, the side door can be moved and opened by pulling the outside handle outward of the vehicle.

The door lock system operates such that, when the outside handle is operated in the direction to open the door with the handle lever moved to assume the non-operable position, the locking lever moved to assume the locked position, and the panic lever moved to assume the non-facing position (hereinafter, "locked state"), the link lever is moved through the handle lever in response to the door-opening operation. During this movement, only the link lever and the panic lever are moved, and the pressing portion of the panic lever does not press the pressure-receiving portion of the ratchet lever. Thus, even when the outside handle is operated in the direction to open the door, the ratchet remains to be engaged by the latch. This means that when the side door is in the closed state, the side door cannot be moved and opened by pulling the outside handle outward of the vehicle.

Unlocking the locked door using the lock knob while the outside handle is operated in the direction to open the door in the locked state will be described below.

When the door-opening operation using the outside handle is performed prior to the unlocking operation, only the link lever and the panic lever are moved without bringing the pressing portion of the panic lever into contact with the pressure-receiving portion of the ratchet lever. When the unlocking operation using the lock knob is performed in this state, the locking lever is rotated from the locked position to the unlocked position. The rotation of the locking lever causes the link lever to swing about the coupling portion between the handle lever and the link lever. At this time, the panic lever is stopped because the pressing portion of the panic lever is caught by the pressure-receiving portion of the ratchet lever. Thus, the pressing portion of the panic lever is positioned away from the distal end of the link lever in the axial direction of the panic lever shaft.

Thereafter, when the door-opening operation using the outside handle is stopped to cause the handle lever rotated from the operable position to the non-operable position, the resilient force of the panic spring rotates the panic lever to bring the pressing portion into proximity of the distal end of the link lever in a radially outward direction with respect to the shaft member. The rotation of the panic lever is stopped when the link lever is partially inserted into the notch in the panic lever and the resilient force of the panic spring brings the side end of the link lever into contact with the deep end of the notch. Hence, the panic lever is located at the facing position, thereby bringing the door lock system into the unlocked state.

When the door-opening operation using the outside handle is performed again in this state, the ratchet is successfully disengaged from the latch, thereby allowing the side door to be moved and opened. Thus, according to the door lock system, when the unlocking operation using the lock knob is performed in the locked state in conjunction with the door-opening operation using the outside handle, the need of operating the lock knob twice to unlock the door is eliminated, thereby reducing the number of operations (for example, see Japanese Patent No. 3574990).

The door lock system is disadvantageous in that, in the course of the panic lever's moving between the position at which the pressing portion is away from the distal end of the link lever in the radially outward direction with respect to the panic lever shaft and the position at which the pressing portion is near the distal end of the link lever in the same direction, the pressing portion of the panic lever can be moved in the axial direction of the panic lever shaft. This can result in a change of a positional relationship between the pressing portion of the panic lever and the distal end of the link lever in the axial direction of the panic lever shaft. If the pressing portion is away from the distal end of the link lever in the axial direction of the panic lever shaft, the link lever is not inserted into the notch in the panic lever, and the side end of the link lever is not brought into contact with the deep end of the notch. Hence, the panic lever undesirably fails to return to the facing position.

When the door-opening operation is performed on the door lock system in the unlocked state with the panic lever not returned to the facing position, it is possible that the pressing portion of the panic lever fails to press the pressing portion of the ratchet lever, which leads to a failure in moving and opening the side door.

SUMMARY OF THE INVENTION

It is an object of the present invention to at least partially solve the problems in the conventional technology.

According to one aspect of the present invention, a door lock system includes a ratchet, a latch, a ratchet lever that disengages the ratchet from the latch when a disengaging operation is performed, a first link lever that moves to and from a transmitting position and a non-transmitting position, wherein when the first link lever is at the transmitting position, the ratchet lever is allowed to disengage the ratchet from the latch, and when the first link lever is at the non-transmitting position, the ratchet lever is inhibited from disengaging the ratchet from the latch, a second link lever that is pivotally coupled to a base end of the first link lever at a base end of the second link lever and that moves in response to a locking operation and an unlocking operation, and a panic spring that transmits, when the unlocking operation is performed, a motion of the second link lever to the first link lever using a resilient force of the panic spring to move the first link lever to the transmitting position. A distal end of the first link lever and a distal end of the second link lever constantly overlap each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a door lock system according to the present invention will be explained below in detail with reference to the accompanying drawings. FIGS. 1 to 5 are diagrams of a door lock system 1 according to the invention. The door lock system 1 taken as an example is for use in a side door D (in a right-hand drive vehicle, the driver's door) which is a front-hinged door provided to the right of a front seat of a four-wheel vehicle as shown in FIG. 6. The door lock system 1 is provided between an outside handle 10 and a latch mechanism 120 shown in FIG. 1.

The door lock system 1 is switched between a locked state and an unlocked state by locking means. Examples of the locking means include a sill knob 9 shown in FIG. 6 disposed in the cabin of the vehicle, a switch (not shown) at the driver's seat, and a switch (not shown) on a key.

Figure 5:
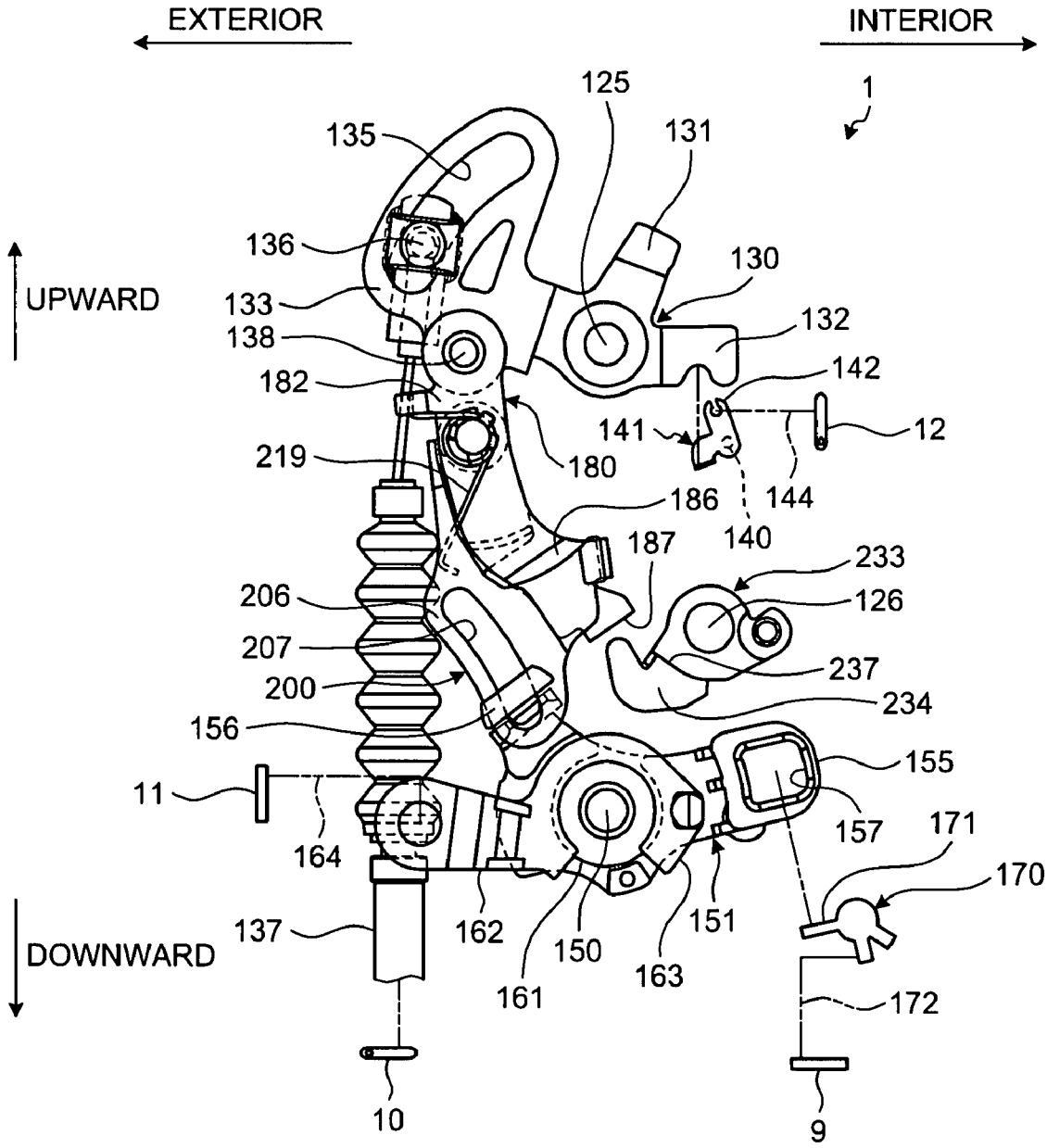
FIG. 5 is a schematic diagram for explaining a plurality of levers in the door lock system shown in FIG. 1.
Figure 6:
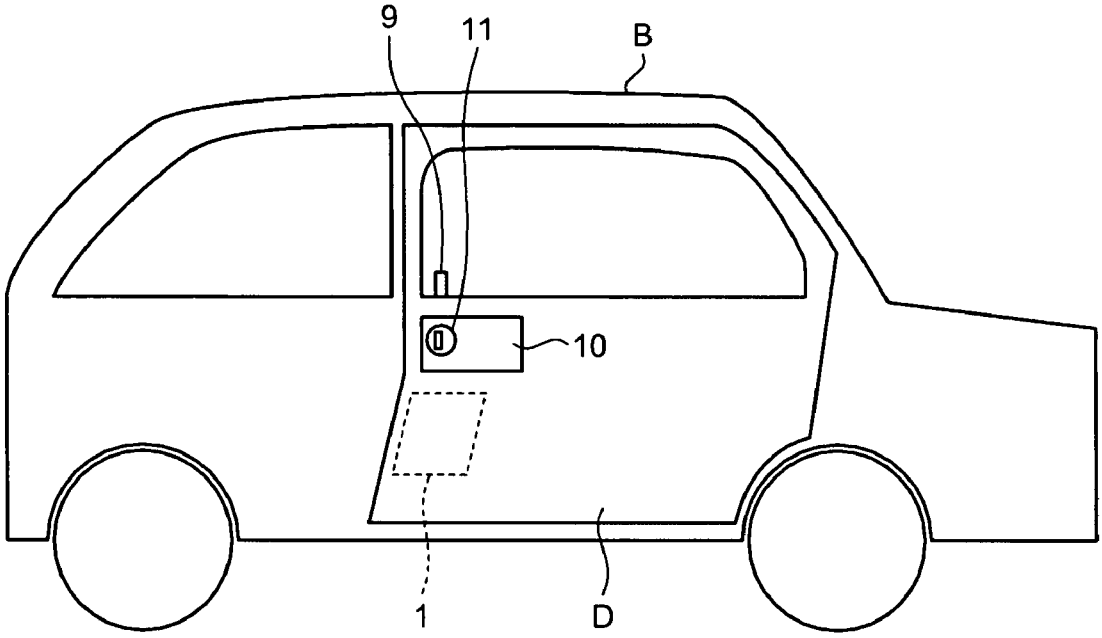
FIG. 6 is a side view of a vehicle to which the door lock system shown in FIG. 1 is applied.

When the door lock system 1 is switched to the locked state, for instance, an inside handle 12 shown in FIG. 5 and the outside handle 10 become ineffective in opening the door (a disengaging operation). On the other hand, when the door lock system 1 is switched to the unlocked state, for instance, the inside handle 12 and the outside handle 10 become effective in opening the door.

Figure 1:
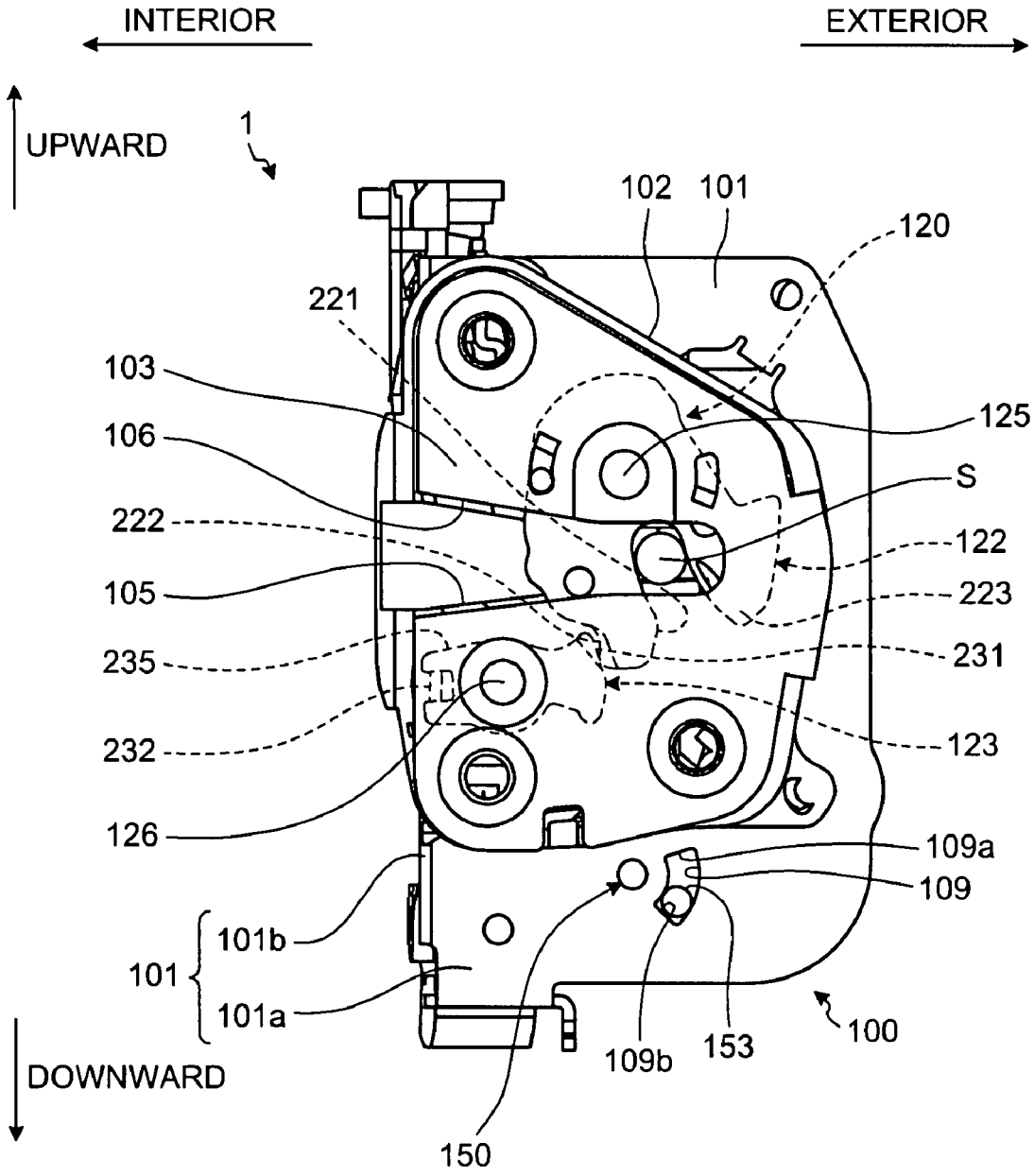
FIG. 1 is a front view of a door lock system according to the present invention.
Figure 2:
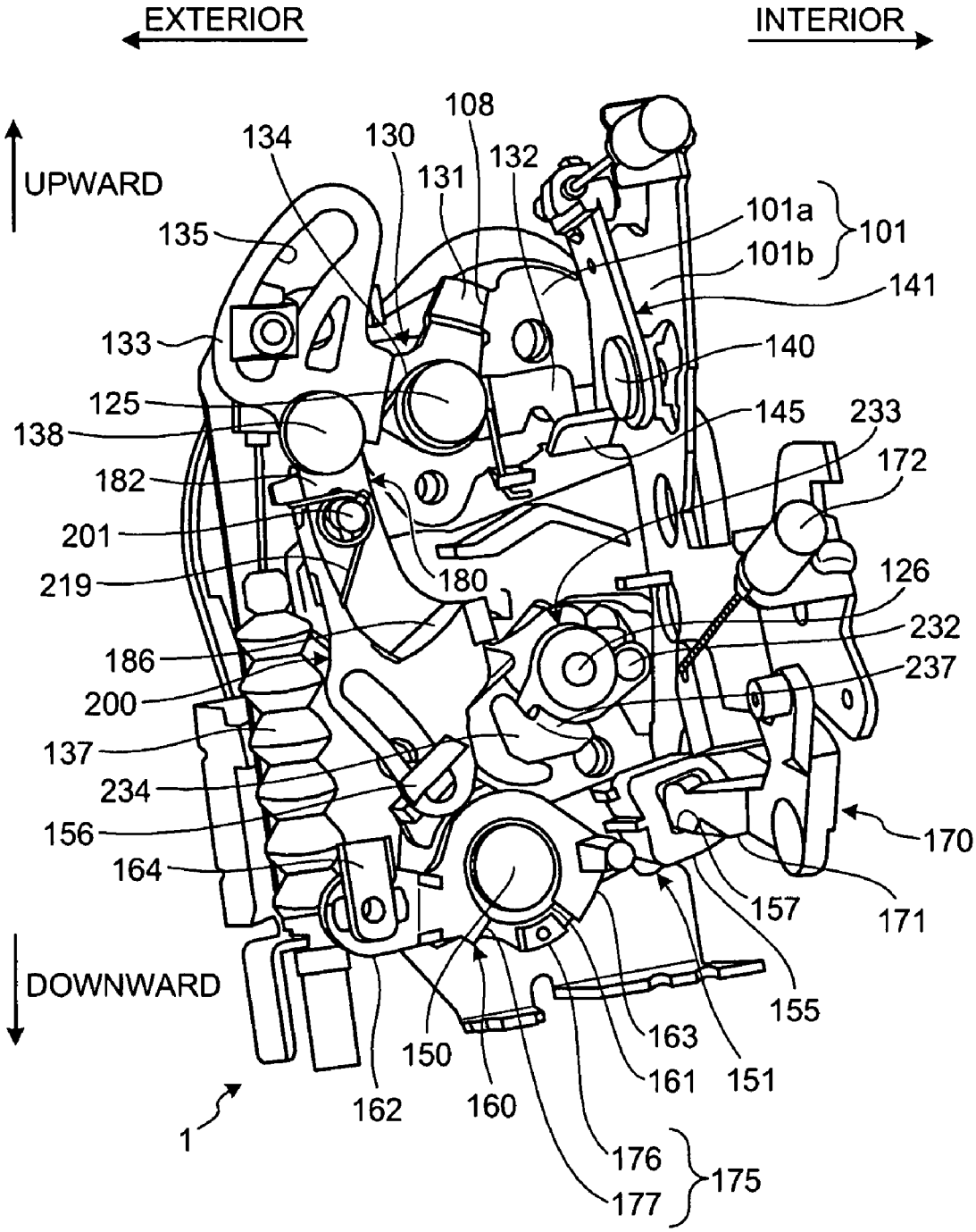
FIG. 2 is a perspective view of relevant parts of the door lock system shown in FIG. 1.
Figure 3:
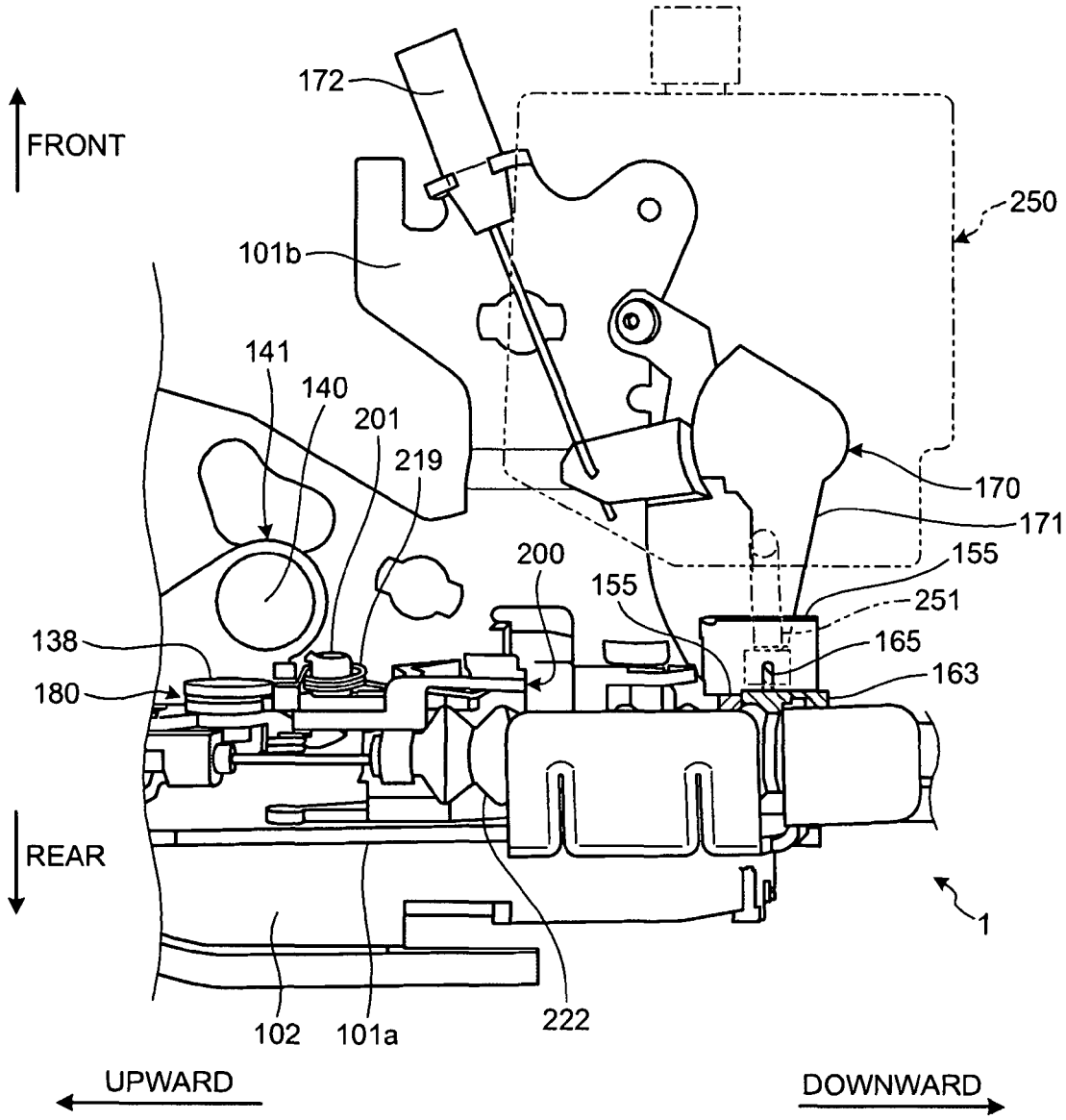
FIG. 3 is a right side view of the door lock system shown in FIG. 1.

The door lock system 1 having such functions includes a base plate 101 as shown in FIGS. 1 to 3. The base plate 101 includes a body portion 101*a* and a flange 101*b*, and is formed from, e.g., a metal material. The body portion 101*a* extends in the widthwise direction and in the vertical direction of the vehicle. The flange 101*b* extends in the front-and-rear direction (hereinafter, "longitudinal direction") and in the vertical direction of the vehicle. As shown in FIG. 1, a cover plate 103 is provided on the backside of the body portion 101*a* of the base plate 101. A latch-mechanism accommodating unit 102 is disposed between the base plate 101 and the cover plate 103.

The latch-mechanism accommodating unit 102 has, at its substantially heightwise midpoint, an accommodating groove 105 to receive the latch mechanism 120 therein. The accommodating groove 105 extends from the interior of the vehicle to the exterior of the vehicle substantially horizontally.

The accommodating groove 105 is a groove extending rightward from a left end of the latch-mechanism accommodating unit 102 in FIG. 1. The accommodating groove 105 is defined at a position and size for accommodating a striker S shown in FIG. 1 therein when the side door D is closed with respect to a vehicle body B shown in FIG. 6. A second accommodating groove 106 formed into a shape corresponding to that of the accommodating groove 105 and that is capable of accommodating the striker S therein when the side door D is closed with respect to a vehicle body B is defined in the cover plate 103.

The latch mechanism 120 is provided to retain the striker S on the vehicle body B by receiving the striker S therein in a locking manner. The latch mechanism 120 includes a ratchet 123 and a latch 122.

The ratchet 123 is disposed at a position below the accommodating groove 105 to be rotatable on a ratchet shaft 126 that extends substantially horizontally in the longitudinal direction of the vehicle body B. The ratchet 123 has a plate shape, and includes a ratchet engaging portion 231 and an actuating arm 235.

The ratchet engaging portion 231 extends radially outward from the ratchet shaft 126 toward the exterior of the vehicle. As shown in FIG. 1, the ratchet engaging portion 231 has a projecting end through which the ratchet engaging portion 231 is engageable with a hook portion of the latch 122, which will be described later. When the ratchet 123 is rotated clockwise in FIG. 1, the ratchet engaging portion 231 is engageable with a latch engaging portion of the latch 122, which will be described later, through the projecting end.

The actuating arm 235 extends radially outward with respect to the ratchet shaft 126 toward the interior of the vehicle and has a coupling pin 232 at its extended end.

A ratchet spring that urges the ratchet 123 counterclockwise is interposed between the ratchet 123 and the latch-mechanism accommodating unit 102.

The latch 122 is disposed at a position above the accommodating groove 105 to be rotatable on a latch shaft 125 that extends substantially horizontally in the longitudinal direction of the vehicle body B. The latch 122 has a plate shape, and includes an engaging groove 221, a hook portion 222, and a latch engaging portion 223.

The engaging groove 221 is a notch defined by notching the outer periphery of the latch 122 toward the latch shaft 125, and of a width capable of accommodating the striker S therein. The engaging groove 221 is defined such that, in the course of counterclockwise rotation of the latch 122 shown in FIG. 7 about the latch shaft 125, the engaging groove 221 intersects with the accommodating groove 105 with the intersecting point being shifted from an opening end to a deep end of the accommodating groove 105.

Figure 7:
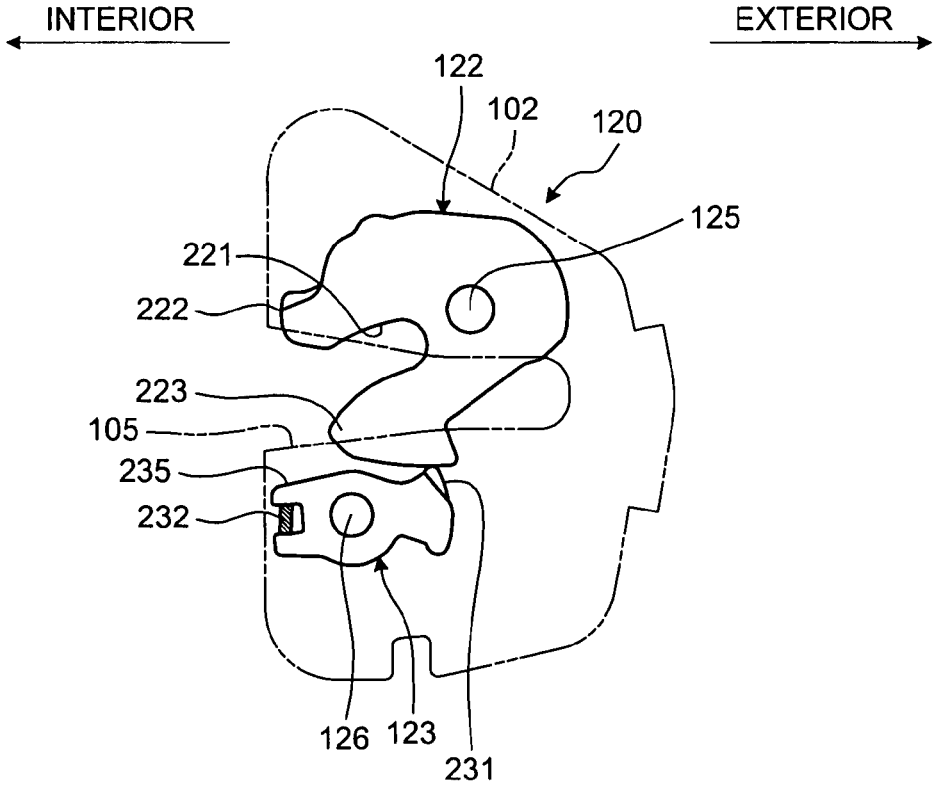
FIG. 7 is a schematic diagram for explaining an operation of a latch mechanism in the door lock system shown in FIG. 1.
Figure 9:
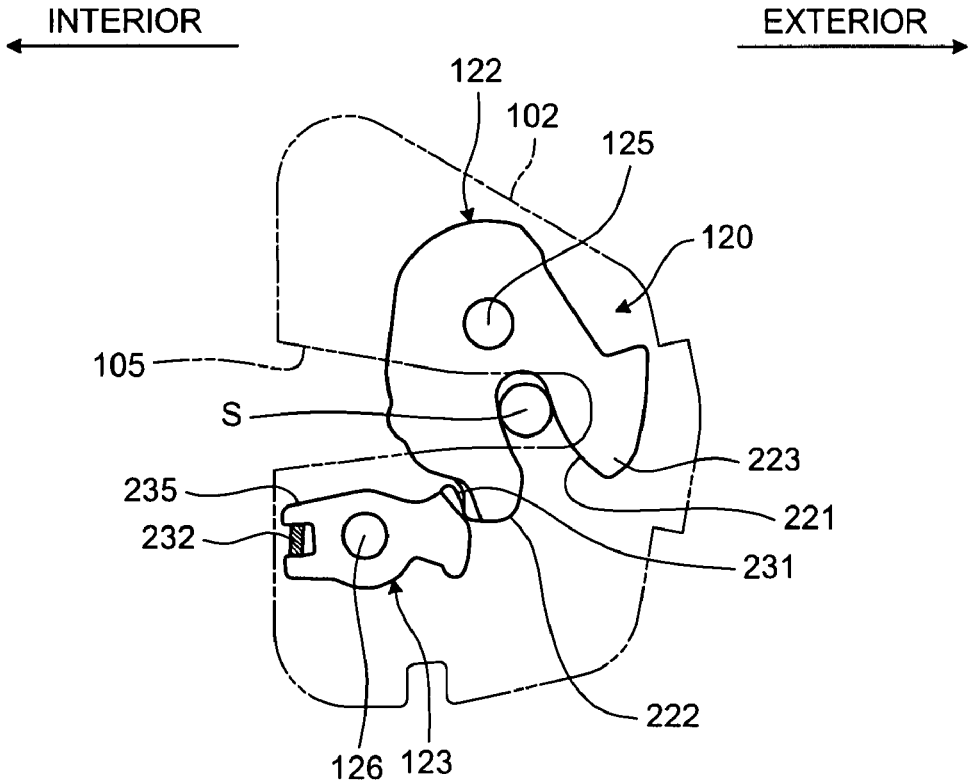
FIG. 9 is still another schematic diagram for explaining an operation of the latch mechanism in the door lock system shown in FIG. 1.

The hook portion 222 is closer to the interior of the vehicle than the engaging groove 221 when the engaging groove 221 is situated to open downward as shown in FIG. 9. The hook portion 222 is formed such that, when the latch 122 is rotated clockwise as shown in FIG. 7, the latch 122 is stopped at a position (open position) where the accommodating groove 105 is open, whereas when the latch 122 is rotated counterclockwise as shown in FIG. 9, the latch 122 is stopped at a position (latch position) where the latch 122 traverses the accommodating groove 105.

As shown in FIG. 9, the latch engaging portion 223 is closer to the exterior of the vehicle than the engaging groove 221 when the engaging groove 221 is situated to open downward. As shown in FIG. 7, the latch engaging portion 223 is formed to traverse the accommodating groove 105 and be gradually inclined upward toward the deep end of the accommodating groove 105 when the latch 122 is rotated clockwise.

A latch spring that urges the latch 122 clockwise is interposed between the latch 122 and the latch-mechanism accommodating unit 102.

In the latch mechanism 120 configured as described above, as shown in FIG. 7, when the side door D is open with respect to the vehicle body B, the latch 122 is positioned at the open position at which the open end of the accommodating groove 105 coincides with the open end of the engaging groove 221. When the side door D is closed in this state, the striker S on the vehicle body B advances into the accommodating groove 105 and comes into contact with the latch engaging portion 223. This causes the latch 122 to rotate counterclockwise in FIG. 7 against the resilient force of the latch spring. Simultaneously, the resilient force of the ratchet spring brings the projecting end of the ratchet engaging portion 231 into sliding contact with the outer periphery of the latch 122. As a result, the ratchet 123 is rotated about the axis of the ratchet shaft 126 along the outer peripheral surface of the latch 122.

Figure 8:
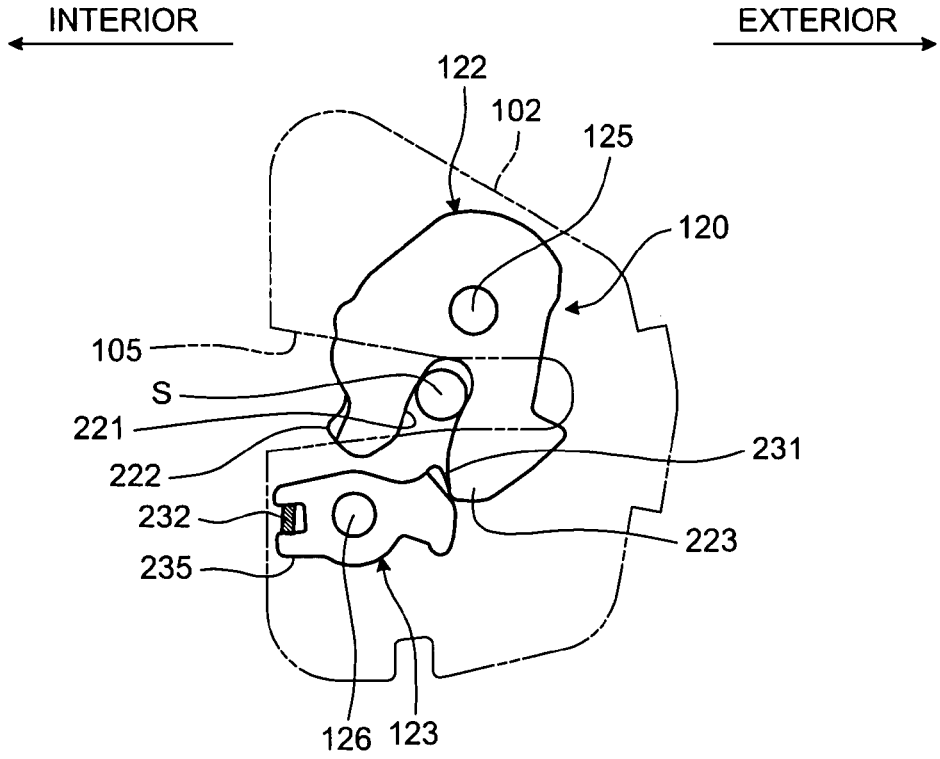
FIG. 8 is another schematic diagram for explaining an operation of the latch mechanism in the door lock system shown in FIG. 1.

The further the side door D is closed in this state, the deeper the striker S into the accommodating groove 105, which causes the latch 122 to further rotate counterclockwise. Eventually, the ratchet engaging portion 231 of the ratchet 123 reaches the engaging groove 221 in the latch 122 as shown in FIG. 8. In this state, the latch engaging portion 223 is in contact with the ratchet engaging portion 231, which prevents the latch 122 from being rotated clockwise by the resilient restoring force of the latch spring. Also in this state, the hook portion 222 of the latch 122 is positioned to traverse the accommodating groove 105, thereby preventing the striker S from being moved by the hook portion 222 in a direction away from the accommodating groove 105; in other words, preventing the side door D from being opened with respect to the vehicle body B (half-latched state).

When the side door D in the half-latched state is further closed, the striker S advancing into the accommodating groove 105 causes the latch 122 to further rotate counterclockwise via the latch engaging portion 223. This brings the striker S into contact with the deep end of the accommodating groove 105. Simultaneously, the hook portion 222 of the latch 122 is brought into contact with the ratchet engaging portion 231, thereby causing the ratchet 123 to rotate clockwise in FIG. 8 against the resilient force of the ratchet spring. Immediately after passage of the hook portion 222 of the latch 122, the resilient restoring force of the ratchet spring causes the ratchet 123 to rotate counterclockwise. This brings the hook portion 222 of the latch 122 into contact with the ratchet engaging portion 231 as shown in FIG. 9. Hence, the latch 122 is prevented from being rotated clockwise against the resilient restoring force of the latch spring. Also in this state, because the hook portion 222 of the latch 122 is positioned to traverse the accommodating groove 105, the hook portion 222 prevents the striker S from moving in a direction away from the deep end of the accommodating groove 105. The side door D is thus retained in the closed state with respect to the vehicle body B (fully-latched state).

When the actuating arm 235 of the ratchet 123 is rotated counterclockwise in FIG. 9 against the resilient force of the ratchet spring in the fully-latched state, the engagement between the hook portion 222 of the latch 122 and the ratchet engaging portion 231 is released. Hence, the resilient restoring force of the latch spring rotates the latch 122 clockwise in FIG. 9. As a result, as shown in FIG. 7, the accommodating groove 105 is opened and the striker S becomes movable in the direction away from the accommodating groove 105. This makes it possible to open the side door D with respect to the vehicle body B.

Figure 10:
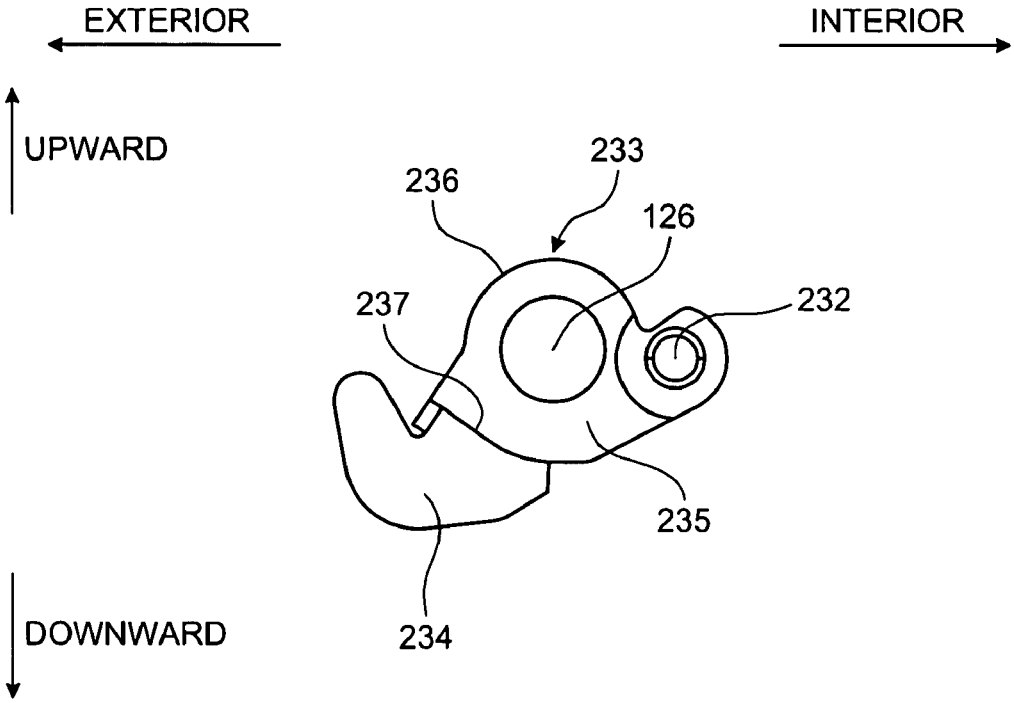
FIG. 10 is a schematic diagram for explaining a ratchet lever in the door lock system shown in FIG. 1.

As shown in FIG. 2, the ratchet shaft 126 extends such that one end of the ratchet shaft 126 projects out of the front face of the body portion 101*a* of the base plate 101. A ratchet lever 233 is provided on the ratchet shaft 126 at its extended end that is positioned forward of the ratchet 123 in the vehicle. The ratchet lever 233 is rotatable about the axis of the ratchet shaft 126. The ratchet lever 233 is operably connected to the ratchet 123 through the coupling pin 232. As shown in FIG. 10, the ratchet lever 233 includes a ratchet lever base 236 formed into a disk surrounding the ratchet shaft 126. The ratchet lever 233 includes a pressure-receiving portion 234 that extends radially outward with respect to the ratchet shaft 126 from the ratchet lever base 236 in a downwardly inclined manner toward the exterior of the vehicle. The pressure-receiving portion 234 has a pressure-receiving wall 237 between the ratchet lever base 236 and a distal end of the pressure-receiving portion 234. The pressure-receiving wall 237 couples the ratchet lever base 236, which is provided at a position relatively near the body portion 101*a* of the base plate 101, to the distal end of the pressure-receiving portion 234, which is provided at a position relatively far from the body portion 101*a* of the base plate 101, and extends in the longitudinal direction of the vehicle. The ratchet lever 233 is interlocked with the ratchet 123 and capable of disengaging the latch 122 from the ratchet 123.

As shown in FIG. 2, the latch shaft 125 extends such that one end of the latch shaft 125 projects out of the front face of the body portion 101*a* of the base plate 101. A handle lever 130 is rotatably provided on the latch shaft 125 at its extended end that is positioned forward of the latch 122 in the vehicle. The handle lever 130 includes a first stopper 131, a handle-pressure-receiving portion 132, and an outside handle connector 133.

As shown in FIG. 5, the first stopper 131 extends upward from the latch shaft 125. As shown in FIG. 2, a handle lever spring 134 is interposed between the handle lever 130 and the base plate 101. The resilient force of the handle lever spring 134 urges the handle lever 130 to rotate counterclockwise in FIG. 5, however, the first stopper 131 abuts a stopper piece 108 shown in FIG. 2, thereby defining a non-operable position of the handle lever 130. The stopper piece 108 is disposed on the body portion 101*a* of the base plate 101.

As shown in FIG. 5, the handle-pressure-receiving portion 132 extends radially outward with respect to the latch shaft 125 toward the interior of the vehicle. The outside handle connector 133 extends radially outward with respect to the latch shaft 125 toward the exterior of the vehicle and then extends upward. A first slide slot 135 is defined in the upwardly extending portion of the outside handle connector 133. The first slide slot 135 is a narrow notch of an arc shape concentric with the latch shaft 125. One end of a first connecting member 137 is connected to the outside handle connector 133 such that a second coupling pin 136 passes through the first slide slot 135. The first connecting member 137 is formed from, e.g., a rod or wire, and the other end of the first connecting member 137 is connected to the outside handle 10. Accordingly, when the outside handle 10 is actuated to open the door, the first connecting member 137 causes the handle lever 130 to rotate from the non-operable position to the operable position. A first-link-lever shaft portion 138, which is to be inserted into a first-link-lever shaft hole 181 to be described later, is provided on the outside handle connector 133.

As shown in FIGS. 2 and 3, an inside-handle lever shaft 140 is disposed in the flange 101*b* of the base plate 101. As shown in FIG. 2, a locking lever shaft 150 is disposed in the body portion 101*a* of the base plate 101.

Figure 11:
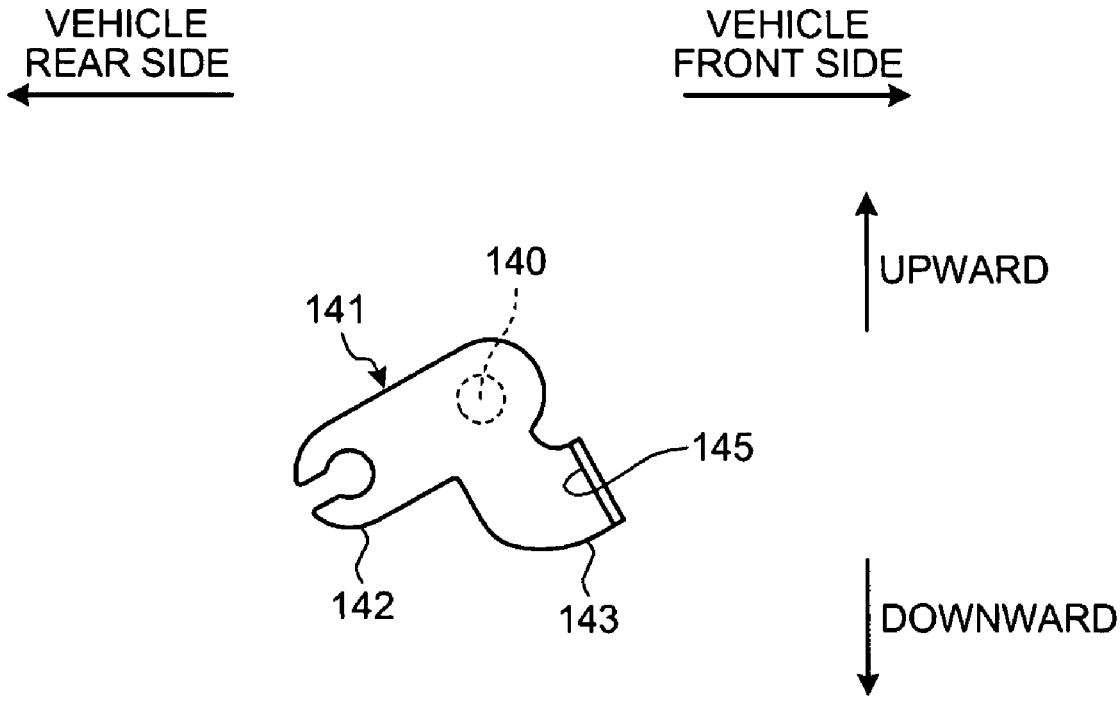
FIG. 11 is a schematic diagram for explaining an inside handle lever in the door lock system shown in FIG. 1.

As shown in FIGS. 2 and 3, an inside handle lever 141 is rotatably disposed on the inside-handle lever shaft 140. The plate-like inside handle lever 141 includes an inside handle connector 142 and a handle pressing portion 143 as shown in FIG. 11.

The inside handle connector 142 extends radially outward with respect to the inside-handle lever shaft 140 in a downwardly inclined manner toward the rear of the vehicle. As shown in FIG. 5, one end of a second connecting member 144 is coupled to the inside handle connector 142. The second connecting member 144 is formed from, e.g., a rod or wire, and the other end of the second connecting member 144 is connected to the inside handle 12 arranged in the cabin of the vehicle. Hence, when the inside handle 12 is actuated to open the door, the second connecting member 144 causes the inside handle lever 141 to rotate clockwise in FIG. 11.

The handle pressing portion 143 extends radially outward with respect to the inside handle lever 141 in a downwardly inclined manner toward the front of the vehicle. A pressing wall 145 is provided on a distal end of the handle pressing portion 143. The pressing wall 145 is formed to project from the front face of the inside handle lever 141 toward the exterior of the vehicle and can press the handle-pressure-receiving portion 132 of the handle lever 130.

The inside handle lever 141 of the above configuration operates such that, when, for instance, the inside handle lever 141 is pulled to open the door and rotated accordingly, the pressing wall 145 of the handle pressing portion 143 presses the handle-pressure-receiving portion 132 of the handle lever 130 in response to the door-opening operation. The handle-pressure-receiving portion 132 presses the handle lever 130, thereby rotating the handle lever 130 from the non-operable position to the operable position.

As shown in FIGS. 2 and 5, a locking lever 151 and a key lever 160 are rotatably provided on the locking lever shaft 150.

Figure 12:
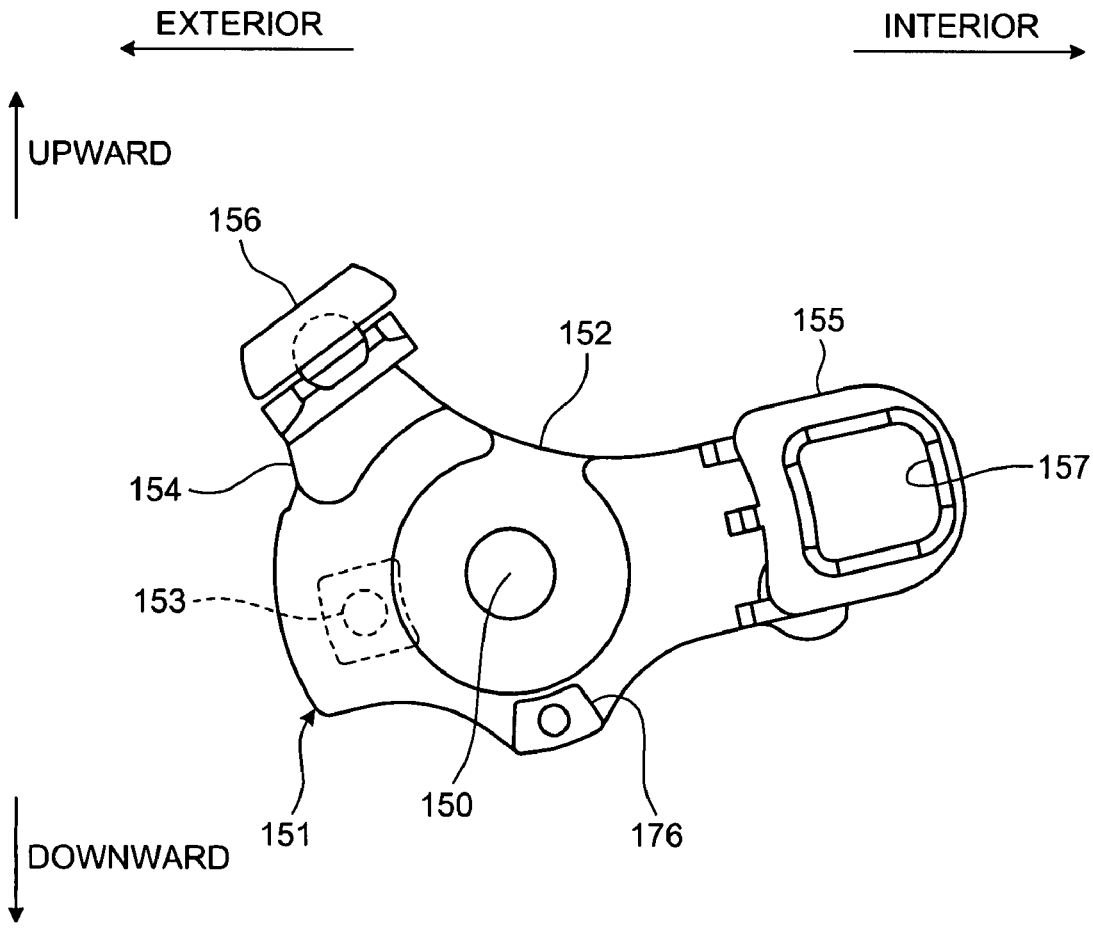
FIG. 12 is a schematic diagram for explaining a locking lever in the door lock system shown in FIG. 1.

As shown in FIG. 12, the locking lever 151 includes a locking lever base 152 formed into a disk surrounding the locking lever shaft 150. A rotation restricting member 153 is disposed on the locking lever base 152. The rotation restricting member 153 is a cylindrical member projecting from the back face of the base plate 101, and inserted into a rotation restricting hole 109 defined in the base plate 101 shown in FIG. 1. The rotation restricting hole 109 is a narrow notch of an arc shape concentric with the locking lever shaft 150. The rotation restricting hole 109 has two locking-lever restricting edges 109*a* and 109*b* each extending radially outward with respect to the locking lever shaft 150. The rotation restricting member 153 comes into contact with the locking-lever restricting edges 109*a*, 109*b* of the rotation restricting hole 109, thereby restricting a rotatable range of the locking lever 151.

As shown in FIG. 12, the locking lever 151 includes a second link connector 154 and a first rod connector 155. The second link connector 154 extends radially outward with respect to the locking lever shaft 150 from the locking lever base 152 in an upwardly inclined manner toward the exterior of the vehicle. A first engaging pin 156 is provided on a distal end of the second link connector 154.

Figure 13:
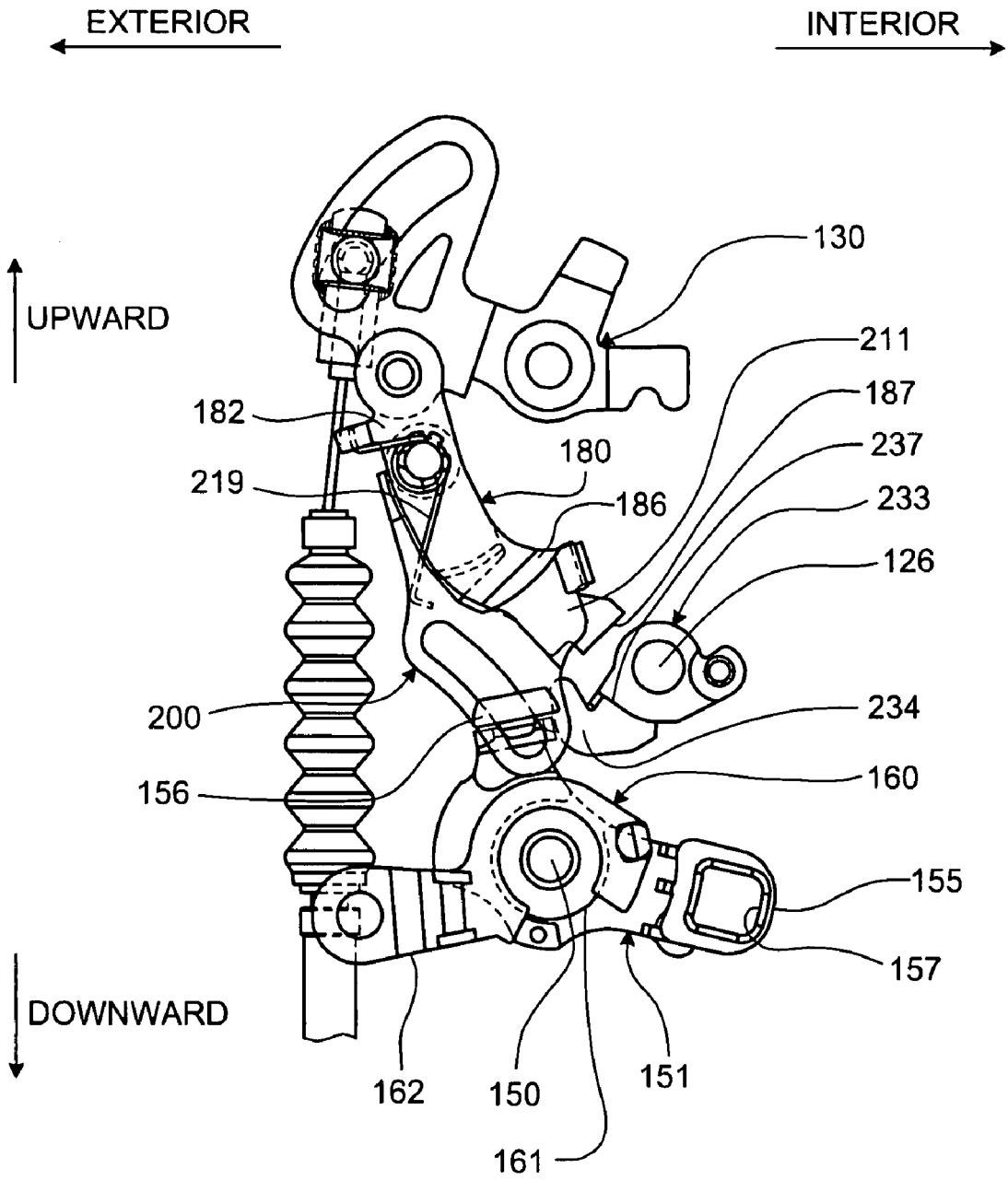
FIG. 13 is a schematic diagram for explaining a locked position of the locking lever shown in FIG. 12.

The first rod connector 155 extends from the locking lever base 152 radially outward with respect to the locking lever shaft 150 toward the interior of the vehicle, and then extends in a direction away from the surface of the base plate 101. A first-rod insertion hole 157 is defined in a distal end of the first rod connector 155. As shown in FIGS. 2 and 3, into the first-rod insertion hole 157 a distal end of a first rod 171 that is included in a rod connecting lever 170 is inserted so that the locking lever 151 is coupled to the rod connecting lever 170 by way of the first-rod insertion hole 157 and the first rod 171. An end of a third connecting member 172 formed from, e.g., a rod or wire, is connected to the rod connecting lever 170. As shown in FIG. 5, the other end of the third connecting member 172 is connected to the sill knob 9. Whereas when, for instance, the sill knob 9 is operated to lock the door, the locking lever 151 rotates from the unlocked position shown in FIG. 5 to the locked position shown in FIG. 13, when the sill knob 9 is operated to unlock the door, the locking lever 151 rotates from the locked position to the unlocked position.

As shown in FIG. 2, the key lever 160 includes a key connector 162, a second rod connector 163, and a key lever base 161 formed into a disk surrounding the locking lever shaft 150.

As shown in FIG. 5, the key connector 162 extends from the key lever base 161 radially outward with respect to the locking lever shaft 150 toward the exterior of the vehicle. As shown in FIGS. 2 and 5, an end of a fourth connecting member 164 formed from, e.g., a rod or wire, is connected to the key connector 162. As shown in FIG. 5, the other end of the fourth connecting member 164 is connected to a key cylinder 11. The key lever 160 is rotated to a second locked position shown in FIG. 14 when the key cylinder 11 with a key inserted thereinto is rotated to lock the door. On the other hand, the key lever 160 is rotated to a second unlocked position shown in FIG. 15 when the key cylinder 11 is rotated to unlock the door. The key lever 160 is at an intermediate position between the second locked position and the second unlocked position under normal conditions.

As shown in FIG. 5, the second rod connector 163 extends from the key lever base 161 radially outward with respect to the locking lever shaft 150 toward the interior of the vehicle. As shown in FIG. 3, a second rod 165 is disposed on a distal end of the second rod connector 163. The second rod 165 is a cylindrical member formed such that a distal end of the second rod 165 projects forward of the vehicle. The distal end of the second rod 165 is inserted into a rod insertion hole defined in a distal end of a first arm 251 provided in an actuator unit 250, thereby coupling the second rod 165 to the first arm 251 so that a drive force of an actuator in the actuator unit 250 is transmitted to the key lever 160. When, for instance, a switch on the key or a switch at the driver's seat is operated to lock the door, the actuator is actuated to rotate the key lever 160 to the second locked position shown in FIG. 14. On the other hand, when the switch on the key or the switch at the driver's seat is operated to unlock the door, the actuator is reversely actuated to rotate the key lever 160 to the second unlocked position shown in FIG. 15.

As shown in FIG. 2, an engaging unit 175 that includes an engaging protrusion 176 and an engaging recess 177 is interposed between the locking lever 151 and the key lever 160. In the embodiment, the engaging protrusion 176 is formed on the locking lever 151, and the engaging recess 177 is formed in the key lever 160.

The engaging unit 175 engages the locking lever 151 and the key lever 160 together such that the locking lever 151 is rotated by rotation of the key lever 160 and the key lever 160 is not rotated by rotation of the locking lever 151.

As shown in FIGS. 2 and 5, a first link lever 180 and a second link lever 200 are provided between the locking lever 151 and the handle lever 130.

Figure 16:
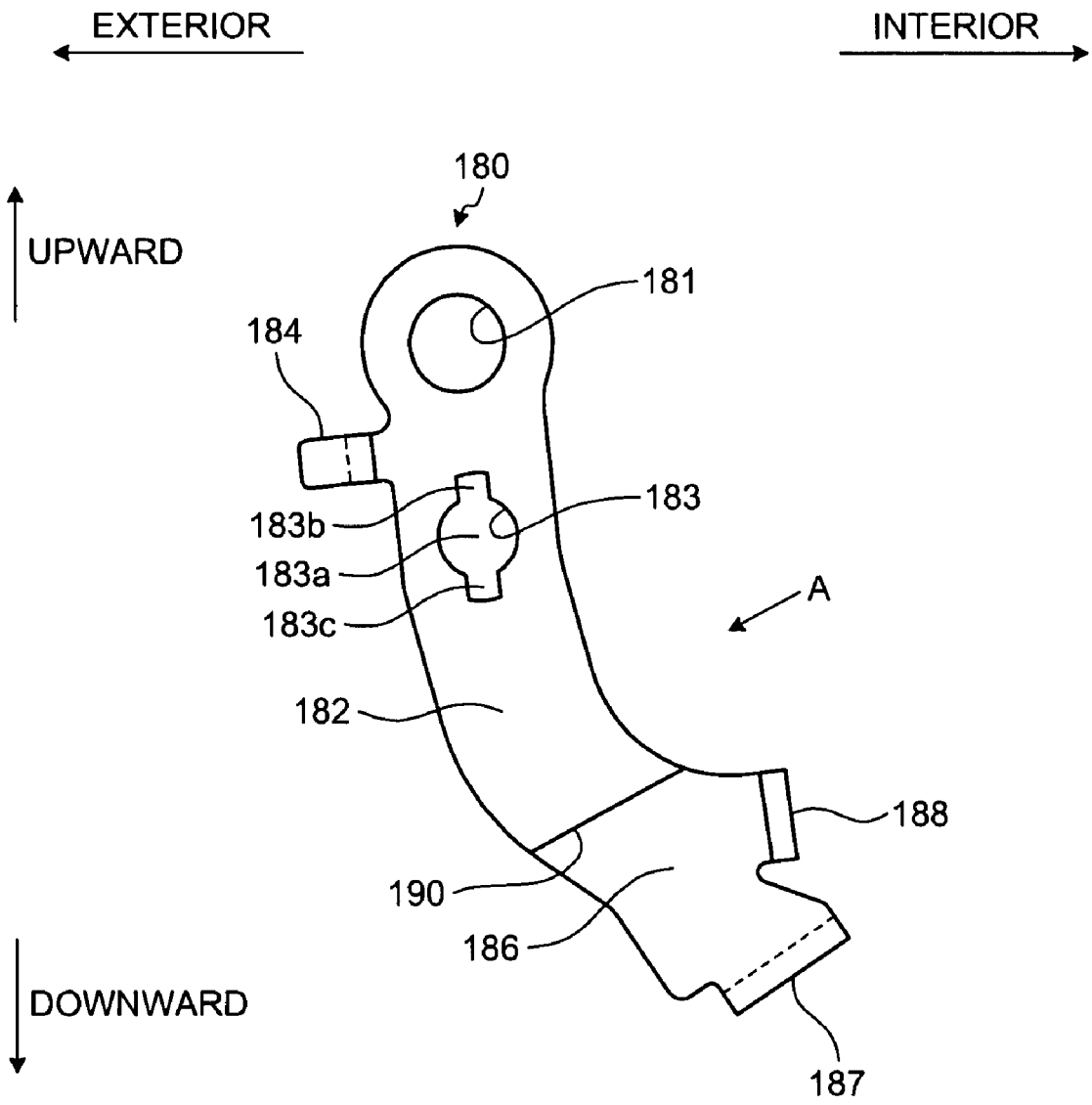
FIG. 16 is a front view of a first link lever in the door lock system shown in FIG. 1.
Figure 17:
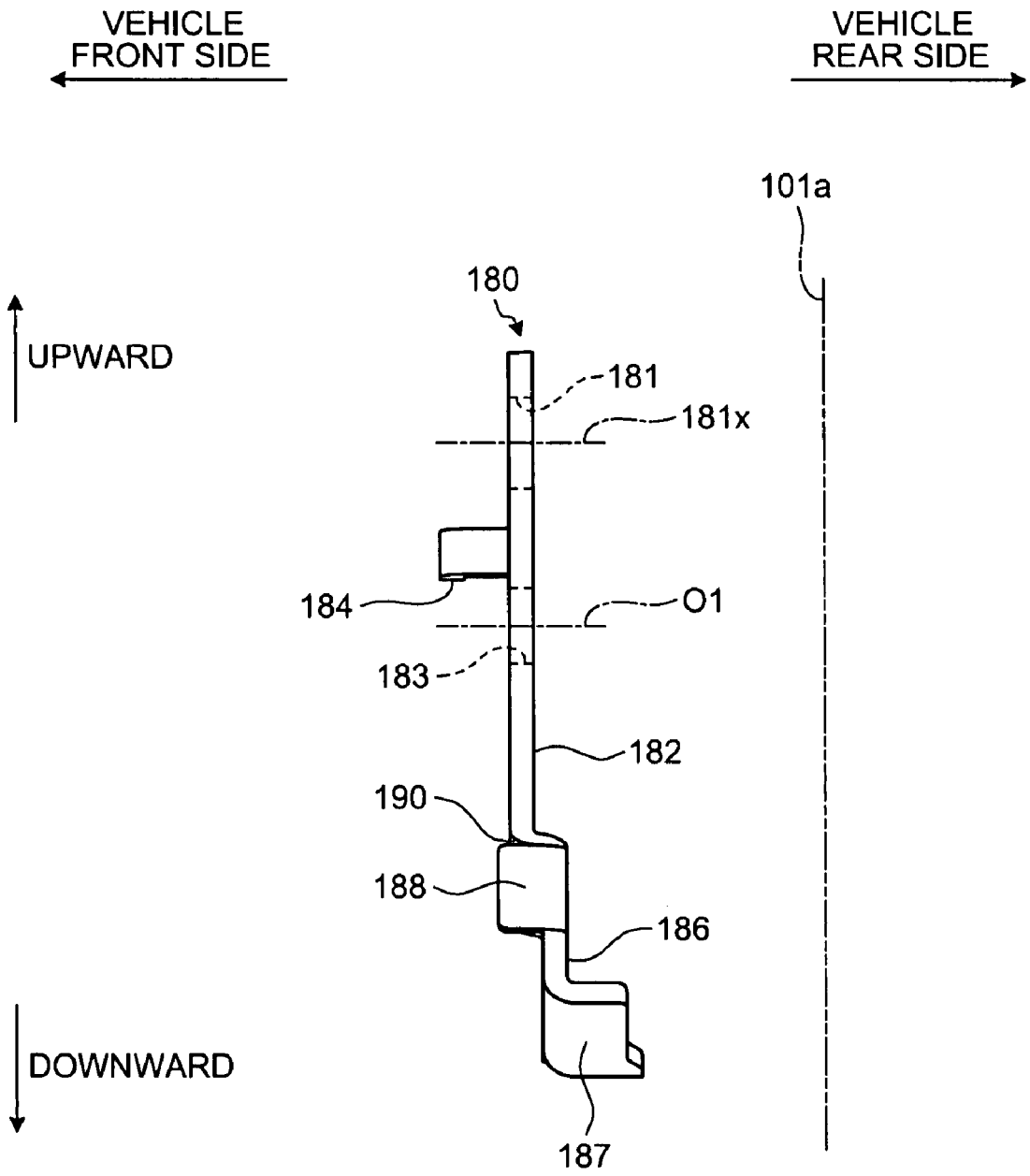
FIG. 17 is a side view of the first link lever shown in FIG. 16.
Figure 18:
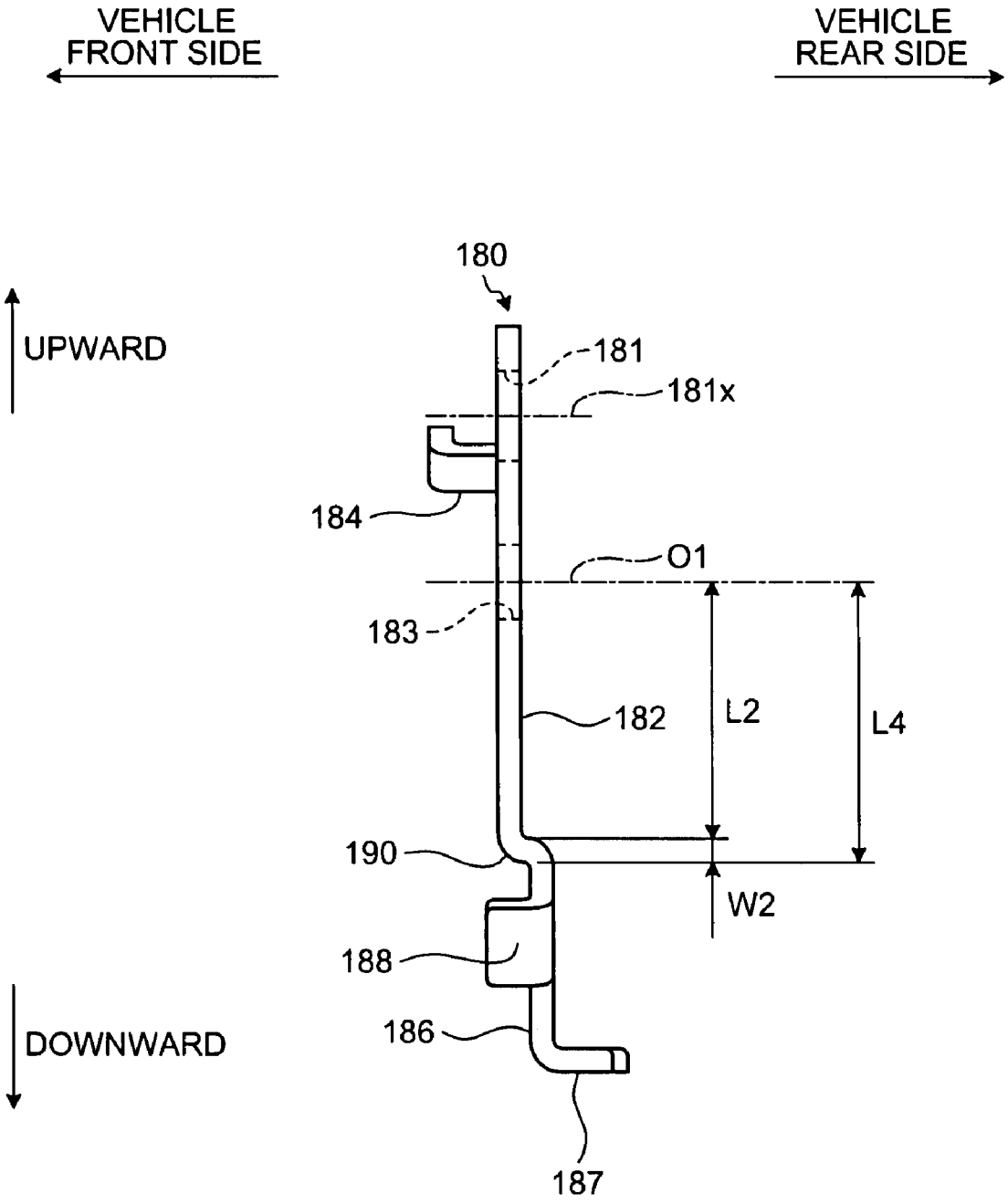
FIG. 18 is a schematic diagram for explaining the first link lever as viewed from a direction indicated by an arrow A of FIG. 16.

The first link lever 180 formed from a metal material carries the first-link-lever shaft hole 181 and includes a first plate portion 182 and a second plate portion 186 as shown in FIGS. 16 to 18. The first-link-lever shaft hole 181 is defined in one end of the first plate portion 182. This end corresponds to a base end of the first link lever 180.

The first plate portion 182 extends downward from a center O1 of the first-link-lever shaft hole 181 and then in an inclined manner toward the interior of the vehicle. The first plate portion 182 carries a shaft insertion hole 183 at substantially a midpoint in its lengthwise direction, and a panic-spring hook 184 near the shaft insertion hole 183.

The shaft insertion hole 183 includes a shaft insertion portion 183*a* and two pin insertion portions 183*b* and 183*c*. The shaft insertion portion 183*a* having a circular shape extends through the first link lever 180. The pin insertion portion 183*b* is a groove extending upward from an upper end of the circular shaft insertion portion 183*a*. The pin insertion portion 183*c* is a groove extending downward from a lower end of the circular shaft insertion portion 183*a*. The pin insertion portions 183*b* and 183*c* are identical in size. The panic-spring hook 184 is formed to project from a side of the first link lever 180 toward the exterior of the vehicle and then projects towards the front of the vehicle.

The second plate portion 186 extends from a distal end of the first plate portion 182 in a downwardly inclined manner toward the interior of the vehicle. More specifically, the second plate portion 186 extends from the distal end of the first plate portion 182 toward the pressure-receiving portion 234 of the ratchet lever 233 when the handle lever 130 is at the non-operable position and the locking lever 151 is at the unlocked position as shown in FIGS. 2 and 5. As shown in FIGS. 16 to 18, the second plate portion 186 includes a pressing portion 187 at its distal end, and a first stopper 188 between a base end and the distal end of the second plate portion 186. The first stopper 188 extends toward the interior of the vehicle. The pressing portion 187 is bent to situate its distal end near the surface of the base plate 101. The first stopper 188 is bent to situate its distal end away from the surface of the base plate 101.

The first link lever 180 has a first step 190 on the boundary between the first plate portion 182 and the second plate portion 186. The first step 190 allows the first link lever 180 to be configured such that, as shown in FIG. 17, the front face of the second plate portion 186 is closer to the front face of the body portion 101*a* of the base plate 101 than the front face of the first plate portion 182, and a back face of the first plate portion 182 and a front face of the second plate portion 186 are essentially flush with each other.

As shown in FIGS. 19 to 22, the second link lever 200 formed from a synthetic resin includes a second link-lever shaft portion (shaft member) 201, a third plate portion 205, a fourth plate portion 206, and a fifth plate portion (overlapping portion) 211. The second-link-lever shaft portion 201 is disposed on one end of the third plate portion 205. This end corresponds to a base end of the second link lever 200.

Figure 22:
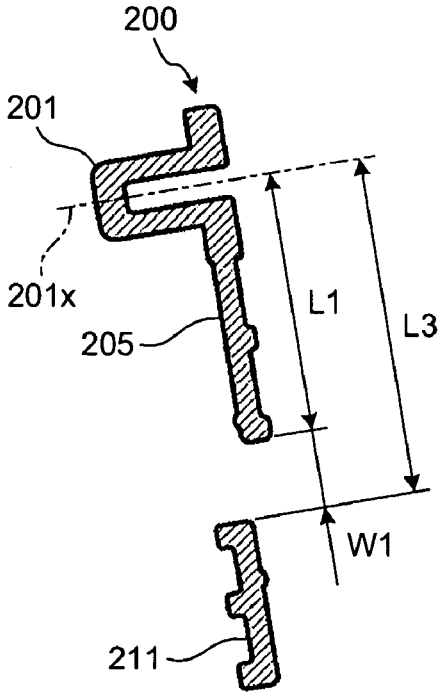
FIG. 22 is a cross section taken along a line B-B of FIG. 19.

The third plate portion 205 extends radially downward with respect to a center axis 201*x* of the second-link-lever shaft portion 201. The radial width of the second-link-lever shaft portion 201 at the third plate portion 205 is approximately equal to that of the first-link-lever shaft hole 181 at the first plate portion 182. A length L1 from the center axis 201*x* of the second-link-lever shaft portion 201 to a distal end of the third plate portion 205 shown in FIG. 22 is set to be smaller than a length L2 from the center C1 of the circular shaft insertion portion 183*a* of the shaft insertion hole 183 in the first link lever shown in FIG. 18 to an upper end of the first step 190.

The second-link-lever shaft portion 201 is formed such that a radial length from the center axis 201*x* is slightly smaller than that of the shaft insertion portion 183*a* of the shaft insertion hole 183 in the first link lever 180. The second-link-lever shaft portion 201 includes three pins 202, 203, and 204. Each of the pins 202, 203, and 204 extends radially outward with respect to the center axis 201*x* of the second-link-lever shaft portion 201. Each of the pins 202, 203, and 204 is slightly smaller in size than the pin insertion portions 183*b* and 183*c* of the shaft insertion hole 183 in the first link lever 180.

The first pin 202 extending radially outward with respect to the center axis 201*x* of the second-link-lever shaft portion 201 is arranged to extend toward 2 o'clock position with respect to the center axis 201*x* when the third plate portion 205 is positioned to extend toward 6 o'clock position. The first pin 202 is disposed at an axial distal end of the second-link-lever shaft portion 201 in an axial direction of the second link lever shaft portion 201.

The second pin 203 extending radially outward with respect to the center axis 201*x* of the second-link-lever shaft portion 201 is arranged to extend toward 4 o'clock position with respect to the center axis 201*x* when the third plate portion 205 is positioned to extend toward 6 o'clock position with respect to the center axis 201*x* of the second link lever shaft portion 201. The second pin 203 is disposed between the front face of the third plate portion 205 and the first pin 202 in the axial direction of the second-link-lever shaft portion 201. More specifically, the second pin 203 is arranged such that a gap between the second pin 203 and the front face of the third plate portion 205 is slightly greater than a longitudinal thickness of the first plate portion 182 on the first link lever 180.

The third pin 204 extending radially outward with respect to the center axis 201*x* of the second-link-lever shaft portion 201 is arranged to extend toward 10 o'clock position with respect to the second-link-lever shaft portion 201 when the third plate portion 205 is positioned to extend toward 6 o'clock position. In other words, the second pin 203 and the third pin 204 extend in the opposite directions. The third pin 204 is disposed between the front face of the third plate portion 205 and the first pin 202 in the axial direction of the second-link-lever shaft portion 200. More specifically, the third pin 204 is arranged such that a gap between the third pin 204 and the surface of the third plate portion 205 is slightly greater than the longitudinal thickness of the first plate portion 182 on the first link lever 180. In addition, the third pin 204 is arranged to have the same spacing distance from the third plate portion 205 as that of the second pin 203 from the third plate portion 205.

The fourth plate portion 206, which is a lower half of the second link lever 200, extends from an exterior side of the third plate portion 205 toward the exterior of the vehicle and then extends downward. The fourth plate portion 206 carries a second slide slot 207. The second slide slot 207 is a vertically-extending narrow notch.

Figure 19:
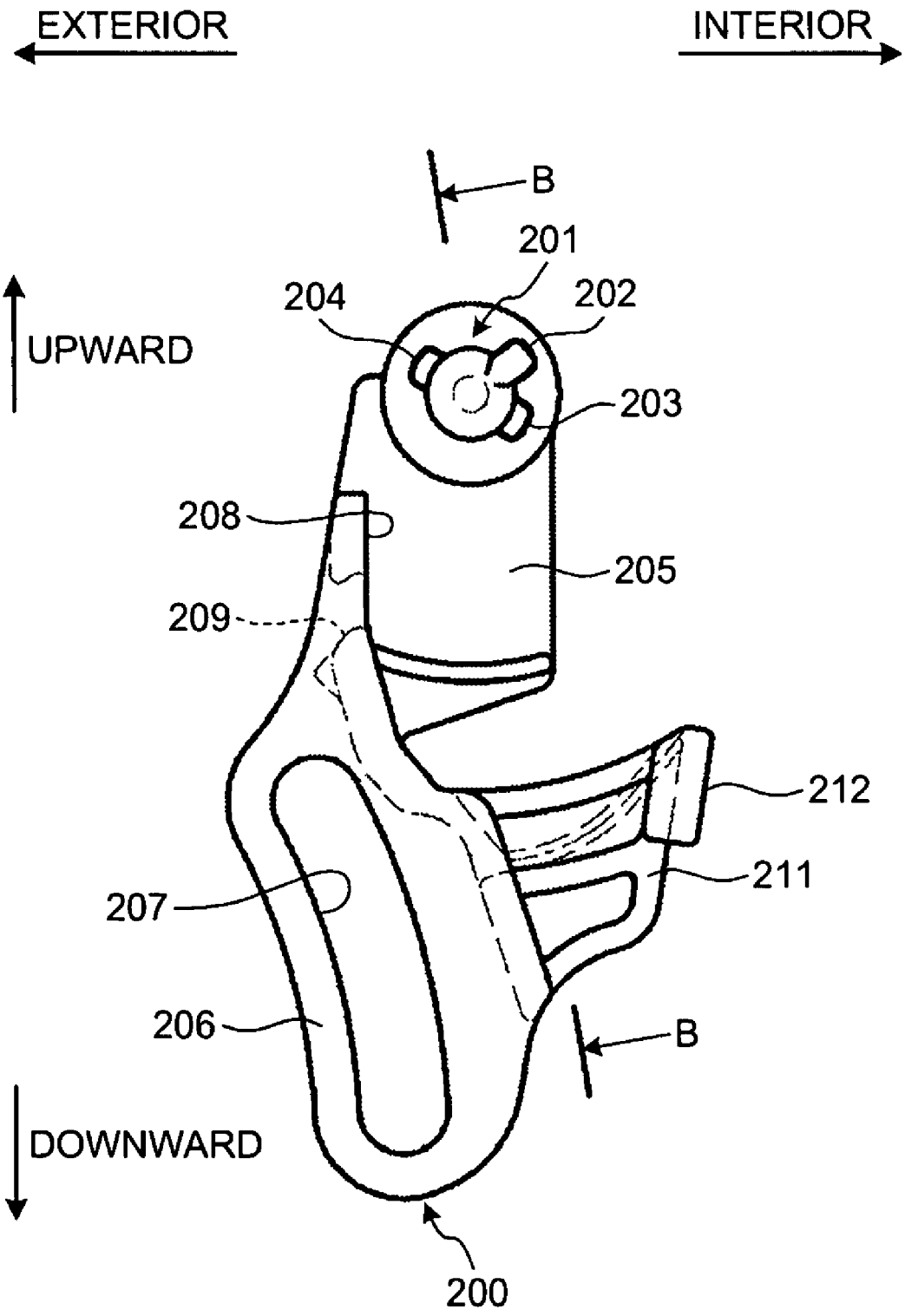
FIG. 19 is a front view of a second link lever in the door lock system shown in FIG. 1.
Figure 20:
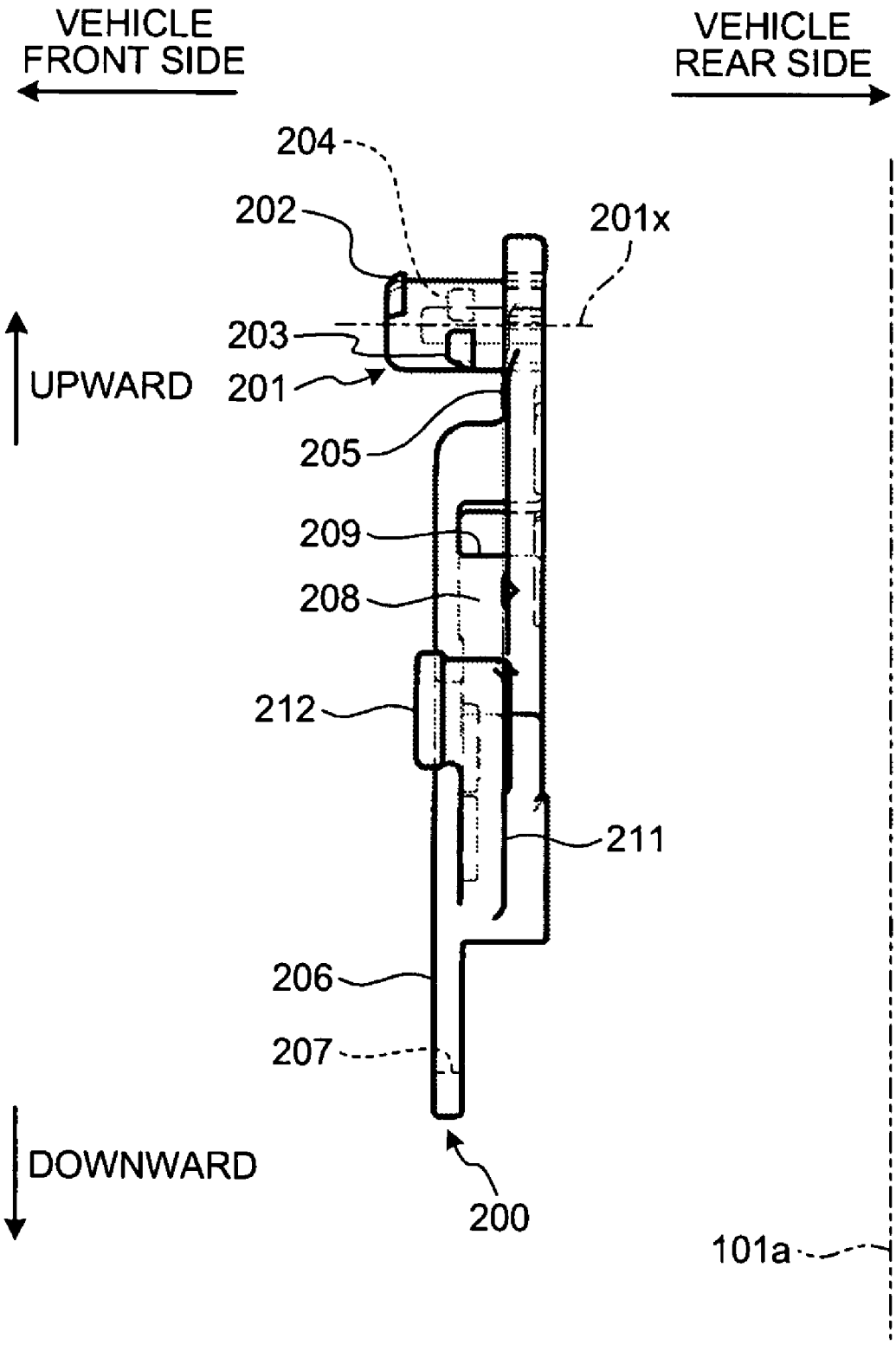
FIG. 20 is a right side view of the second link lever shown in FIG. 19.

The second link lever 200 has a second step 208 on the boundary between the third plate portion 205 and the fourth plate portion 206. The second step 208 allows the second link lever 200 to be configured such that, as shown in FIG. 20, the front face of the fourth plate portion 206 is less close to the surface of the body portion 101*a* of the base plate 101 than the front face of the third plate portion 205. The second step 208 is inclined with respect to the vertical direction. As shown in FIGS. 19 and 20, a spring insertion hole 209 is defined in the second step 208 through the second lever 200.

Figure 21:
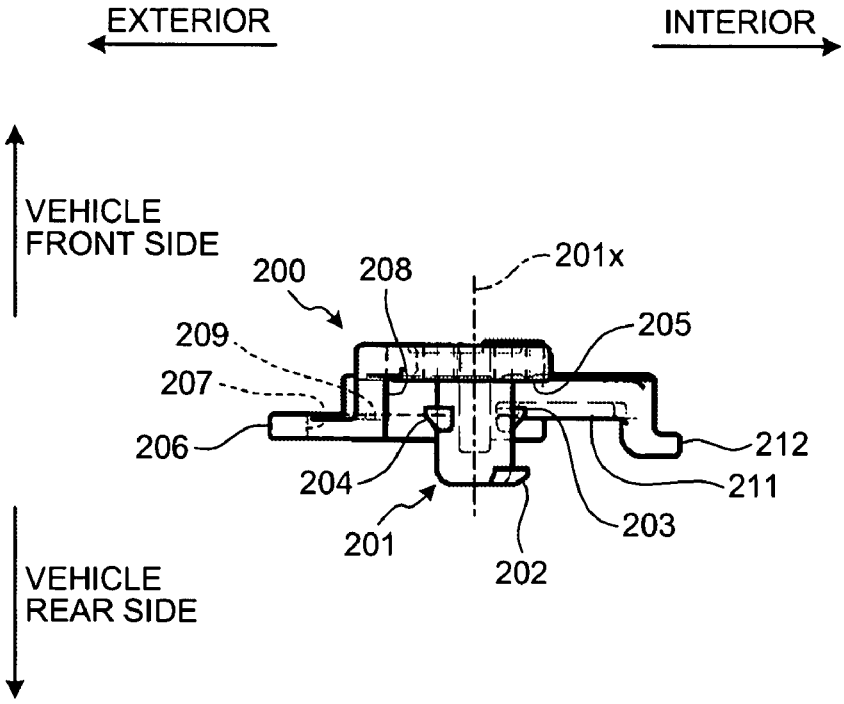
FIG. 21 is a plan view of the second link lever shown in FIG. 19.

As shown in FIG. 19, the fifth plate portion 211 extends from an interior side of the fourth plate portion 206 toward the interior of the vehicle. The fifth plate portion 211 also extends radially outward with respect to the second link-lever shaft portion 201. The fifth plate portion 211 and the third plate portion 205 extend in an essentially same direction. A gap W1 between the distal end of the third plate portion 205 and the base end of the fifth plate portion 211 is greater than a vertical width W2 of the first step 190 on the first link lever 180 shown in FIG. 18. A length L3 from the center axis 201*x* of the second-link-lever shaft portion 201 to a base end of the fifth plate portion 211 shown in FIG. 22 is set to be greater than a length L4 from the center O1 of the circular shaft insertion portion 183*a* of the shaft insertion hole 183 in the first link lever 180 shown in FIG. 18 to a lower end of the first step 190. The radial width of the center axis 201*x* of the second-link-lever shaft portion 201 at the fifth plate portion 211 is approximately equal to a circumferential width of the center O1 at the shaft insertion portion 183*a* of the first-link-lever shaft hole 181 in the second plate portion 186. As shown in FIG. 22, the fifth plate portion 211 is attached to the fourth plate portion 206 such that the back face of the fifth plate portion 211 is approximately flush with the front face of the third plate portion 205. As shown in FIGS. 20 and 21, the fifth plate portion 211 has, at its distal end projecting toward the interior of the vehicle, a projecting pawl 212 that projects toward the front of the vehicle.

Figure 23:
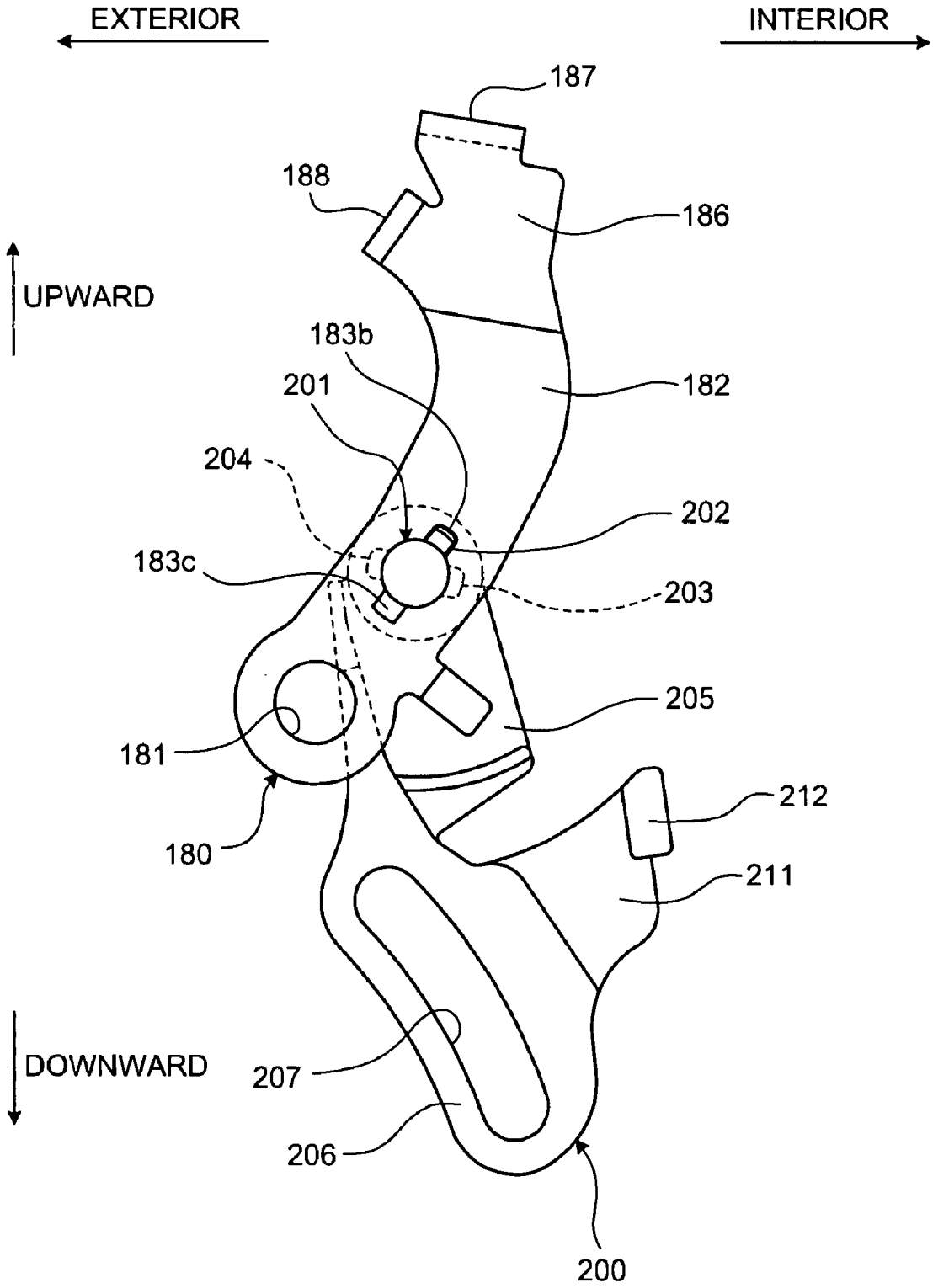
FIG. 23 is a schematic diagram for explaining a coupling scheme between the first link lever shown in FIG. 16 and the second link lever shown in FIG. 19.

Coupling between the first link lever 180 and the second link lever 200 will be described below. First, the first link lever 180 and the second link lever 200 are moved to bring the front face of the second link lever 200 into proximity of back face of the first link lever 180. The second link lever 200 is then positioned such that the shaft insertion portion 183*a* of the shaft insertion hole 183 in the first link lever 180 coincides with the second-link-lever shaft portion 201 of the second link lever 200 and that, as shown in FIG. 23, the third plate portion 205 extends toward 6 o'clock position with respect to the second-link-lever shaft portion 201. The first link lever 180 is positioned such that the base end of the first plate portion 182 extends toward 2 o'clock position with respect to the center C1 of the shaft insertion portion 183*a* of the first-link-lever shaft hole 181.

Subsequently, the first link lever 180 and the second link lever 200 are moved to bring the back face of the first link lever 180 into closer proximity of the front face of the second link lever 200, thereby causing the second-link-lever shaft portion 201 to pass through the shaft insertion portion 183*a* of the shaft insertion hole 183, and causing the first pin 202 to pass through the pin insertion portion 183*b* of the shaft insertion hole 183.

Figure 24:
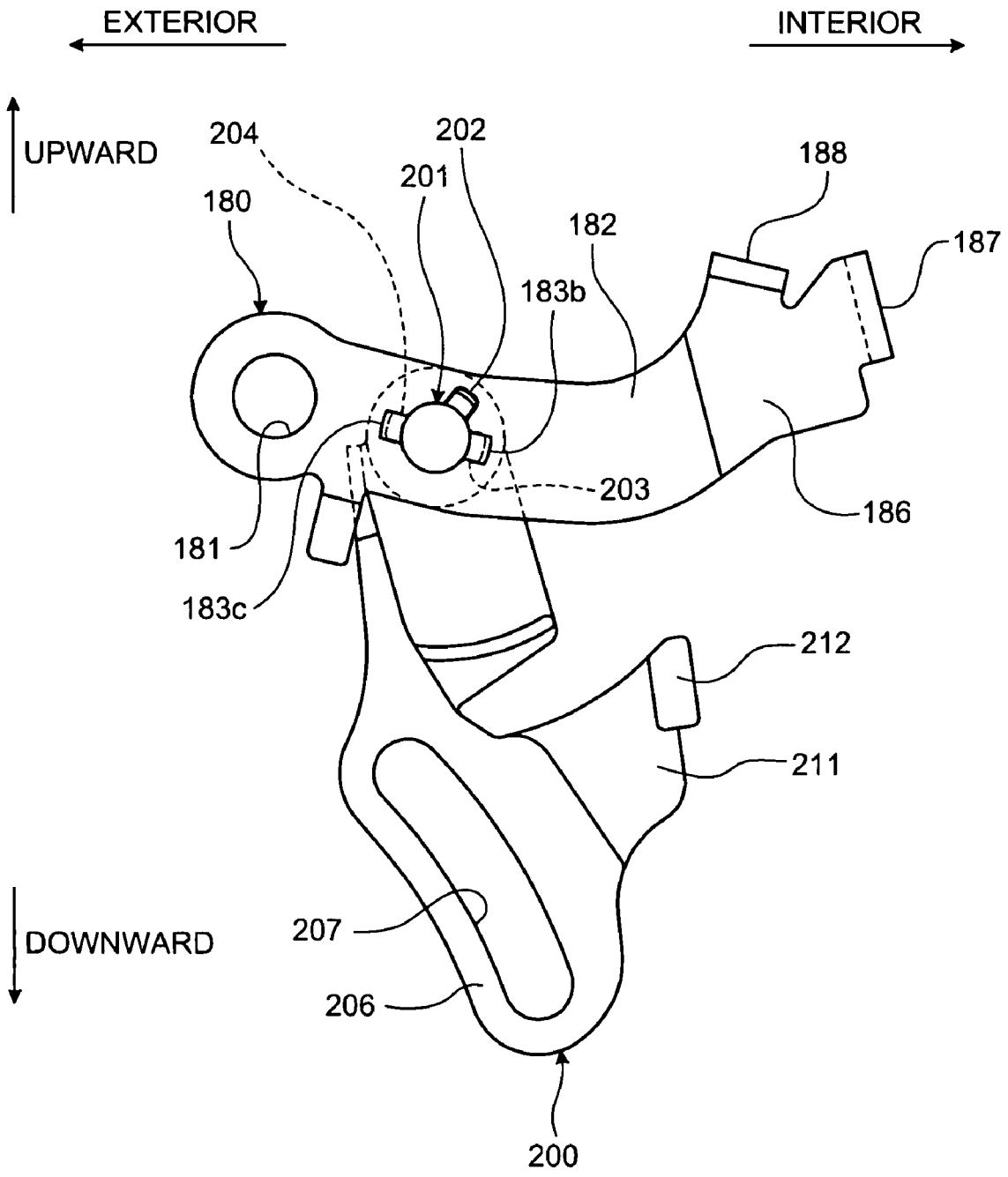
FIG. 24 is another schematic diagram for explaining a coupling scheme between the first link lever shown in FIG. 16 and the second link lever shown in FIG. 19.

Subsequently, as shown in FIG. 24, the second link lever 200 is positioned such that the third plate portion 205 extends toward 6 o'clock position with respect to the second-link-lever shaft portion 201. The first link lever 180 is positioned such that the base end of the first plate portion 182 extends toward 4 o'clock position with respect to the center O1 of the shaft insertion portion 183*a* of the first-link-lever shaft hole 181.

The first link lever 180 and the second link lever 200 are further moved to bring the back face of the first link lever 180 into still closer proximity of the front face of the second link lever 200, thereby causing the second pin 203 to pass through the pin insertion portion 183*b* of the shaft insertion hole 183, and causing the third pin 204 to pass through the pin insertion portion 183*c* of the shaft insertion hole 183.

Figure 25:
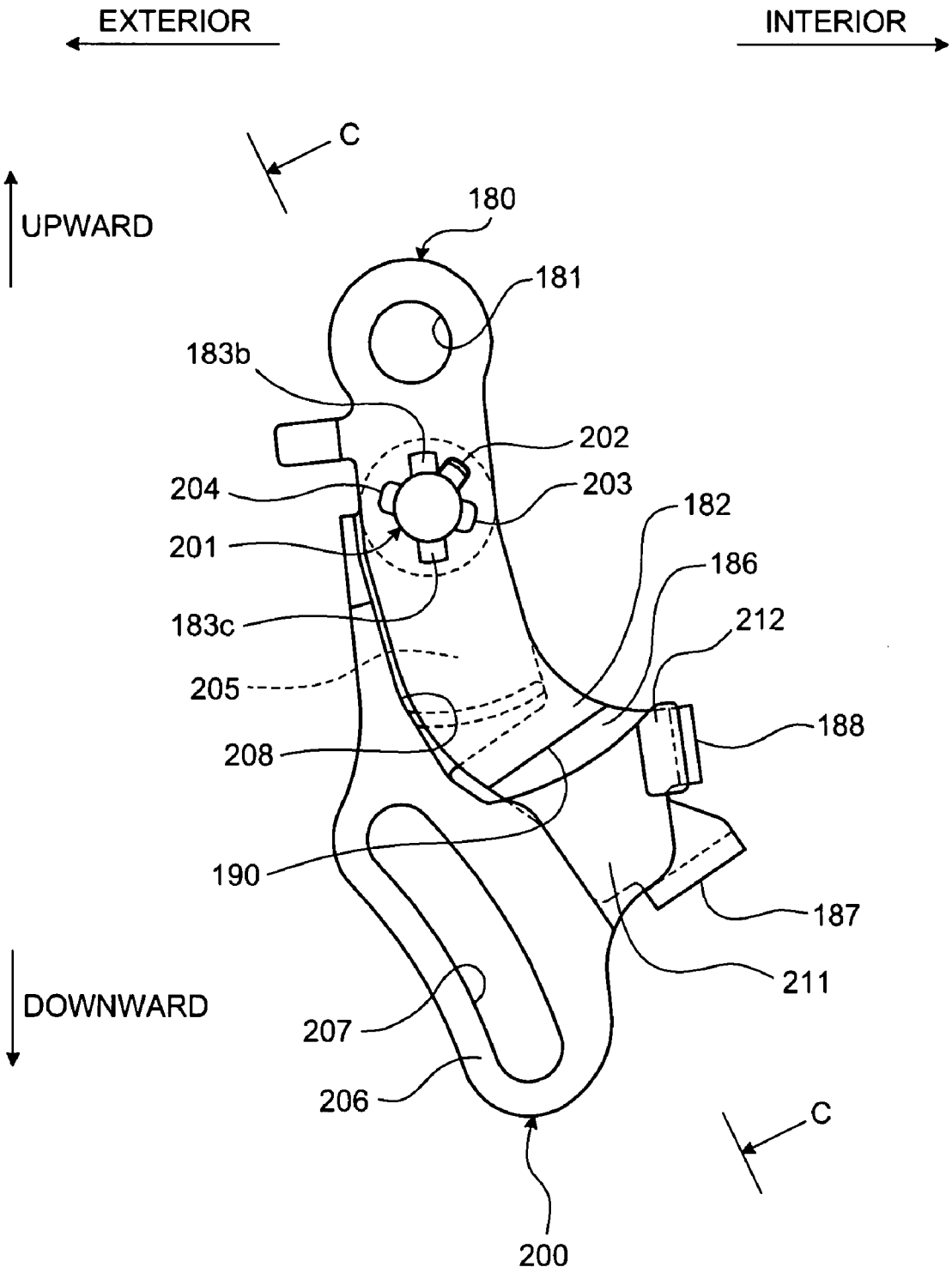
FIG. 25 is another schematic diagram for explaining a coupling scheme between the first link lever shown in FIG. 16 and the second link lever shown in FIG. 19.
Figure 26:
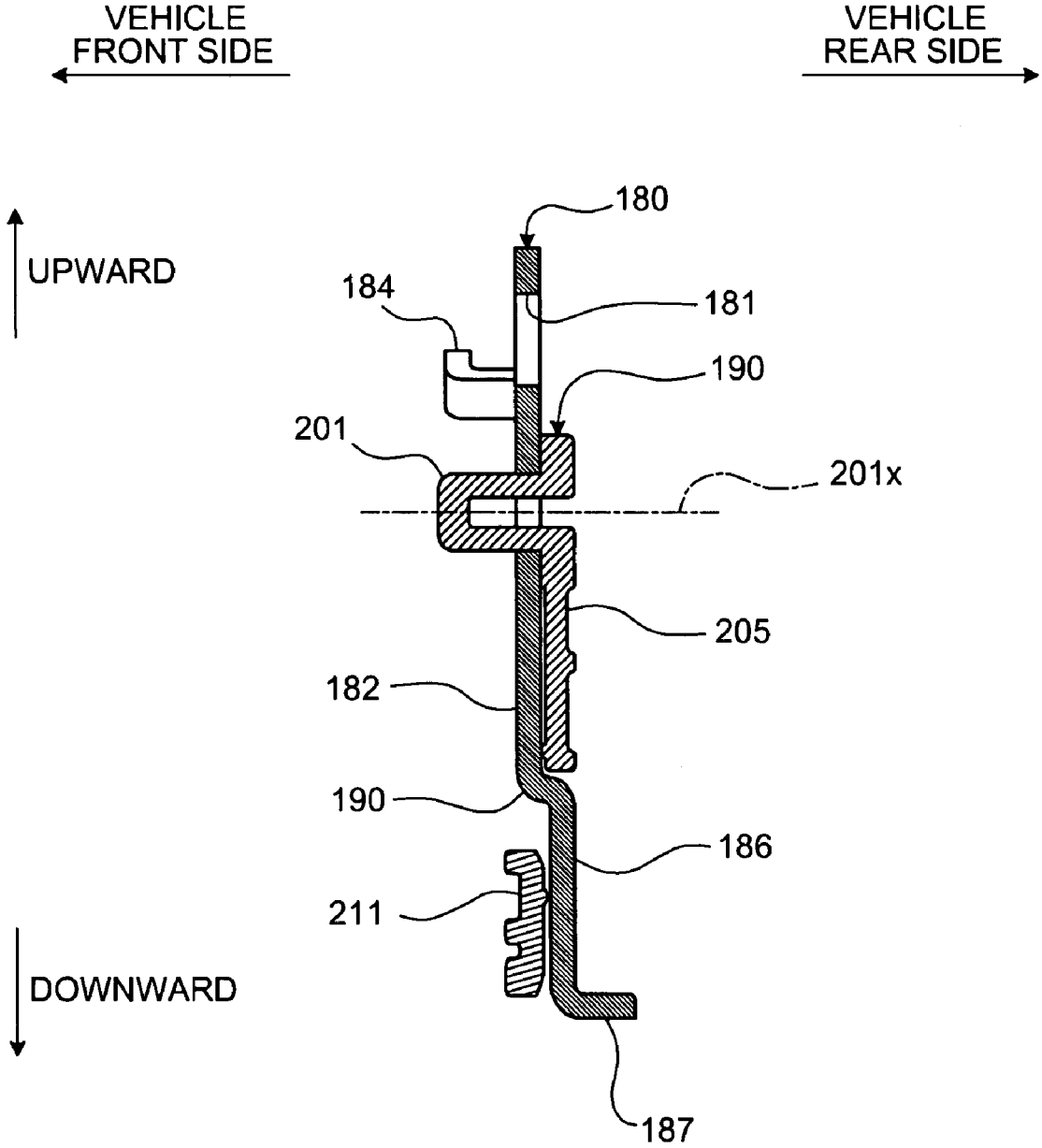
FIG. 26 is a cross section taken along a line C-C of FIG. 25.

As shown in FIG. 25, the first link lever 180 is rotated clockwise to bring an exterior-side end of the first link lever 180 into contact with the second step 208 of the second link lever 200. By this contact, the first step 190 of the first link lever 180 is brought to a position between the distal end of the third plate portion 205 of the second link lever 200 and the base end of the fifth plate portion 211 as shown in FIG. 26. This is because, as described above, the length L1 from the center axis 201*x* of the second-link-lever shaft portion 201 to the distal end of the third plate portion 205 shown in FIG. 22 is set to be smaller than the length L2 from the center O1 of the circular shaft insertion portion 183*a* of the shaft insertion hole 183 in the first link lever shown in FIG. 18 to the upper end of the first step 190, and the length L3 from the center axis 201*x* of the second-link-lever shaft portion 201 to the base end of the fifth plate portion 211 shown in FIG. 22 is set to be greater than the length L4 from the center O1 of the circular shaft insertion portion 183*a* of the shaft insertion hole 183 in the first link lever shown in FIG. 18 to the lower end of the first step 190.

In the door lock system 1, the fifth plate portion 211 has, at its distal end projecting toward the interior of the vehicle, the pawl 212 that projects toward the front the vehicle. The pawl 212 prevents the first link lever 180 from not being interposed between the third plate portion 205 on the base end of the second link lever 200 and the fifth plate portion 211 on the distal end of the same.

In the door lock system 1, coupling between the first link lever 180 and the second link lever 200 with the second-link-lever shaft portion 201 therebetween allows relative rotation of the first link lever 180 and the second link lever 200.

Figure 4:
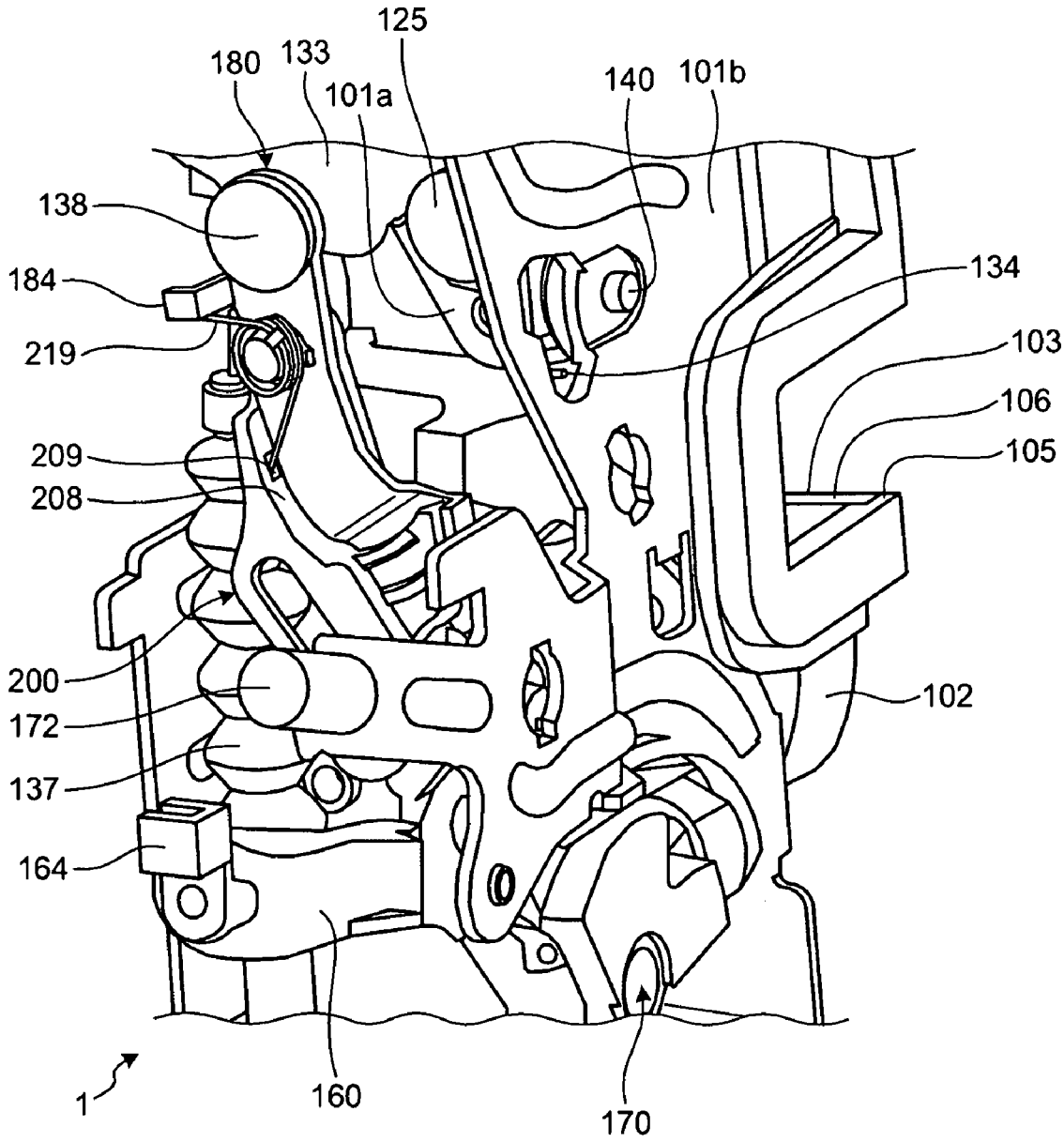
FIG. 4 is a schematic diagram for explaining a panic spring in the door lock system shown in FIG. 1.

As shown in FIG. 2, a panic spring 219 is interposed between the first link lever 180 and the second link lever 200 with the exterior-side end of the first link lever 180 in contact with the second step 208 of the second link lever 200. One end of the panic spring 219, which is a torsion spring, is hooked up to the panic-spring hook 184 on the first link lever 180, and the other end is inserted into the spring insertion hole 209 as shown in FIG. 4. The panic spring 219 is thus engaged with the second step 208. The resilient force of the panic spring 219 brings the exterior-side end of the first link lever 180 into contact with the second step 208 of the second link lever 200. Hence, a proximity arrangement in which the distal end of the first link lever 180 and that of the second link lever 200 are close to each other is defined. The second step 208 thus functions as a stopper that defines the proximity arrangement of the second link lever 200 and the first link lever 180. In this state, on the base ends of the link levers 180 and 200, the back face (first surface) of the first link lever 180 and the front face (second surface) of the second link lever face each other, and, as shown in FIG. 25, the base end of the first link lever 180 and the base end of the second link lever 200 overlap each other. In addition, as shown in FIG. 26, on the distal ends of the link levers 180 and 200, the front face (second surface) of the first link lever 180 and the back face (first surface) of the second link lever 200 face each other, and, as shown in FIG. 25, the distal end of the first link lever 180 and the distal end of the second link lever 200 overlap each other. The first link lever 180 is interposed between the third plate portion 205 on the base end and the fifth plate portion 211 on the distal end of the second link lever 200.

The first-link-lever shaft portion 138 of the outside-handle connector 133 is inserted into the first-link-lever shaft hole 181 to couple the first link lever 180 to the handle lever 130 for relative rotation.

As shown in FIG. 5, the first engaging pin 156 of the locking lever 151 is inserted into the second slide slot 207 in the fourth plate portion 206 to couple the second link lever 200 to the locking lever 151 for relative movement.

The first link lever 180 and the handle lever 130 are coupled to each other, and the second link lever 200 and the locking lever 151 are coupled to each other as described above. Hence, when the handle lever 130 is moved from the non-operable position to the operable position, the first link lever 180 and the second link lever 200 are moved in response to the motion of the handle lever 130. In addition, when the locking lever 151 is moved from the unlocked position to the locked position, or vise versa, the first link lever 180 is caused to pivot about the axis of the first-link-lever shaft portion 138. More specifically, when the unlocking operation is performed, the locking lever 151 is pivoted to the unlocked position. In response thereto, the first link lever 180 is pivoted to bring the pressing portion 187 to a position (hereinafter, "transmitting position" of the first link lever 180) at which the pressing portion 187 opposes the pressure-receiving portion 234 of the ratchet lever 233, and the second link lever 200 is moved to a third unlocked position so that the first link lever 180 is moved to the transmitting position. When the locking operation is performed, the locking lever 151 is rotated to the locked position. In response thereto, the first link lever 180 is pivoted to bring the pressing portion 187 to a position (hereinafter, "non-transmitting position" of the first link lever 180) at which the pressing portion 187 is out of the transmitting position, and the second link lever 200 is moved to a third locked position so that the first link lever 180 is moved to the non-transmitting position. The second link lever 200 is moved by the pivoting of the first link lever 180 and the rotation of the locking lever 151.

Figure 27:
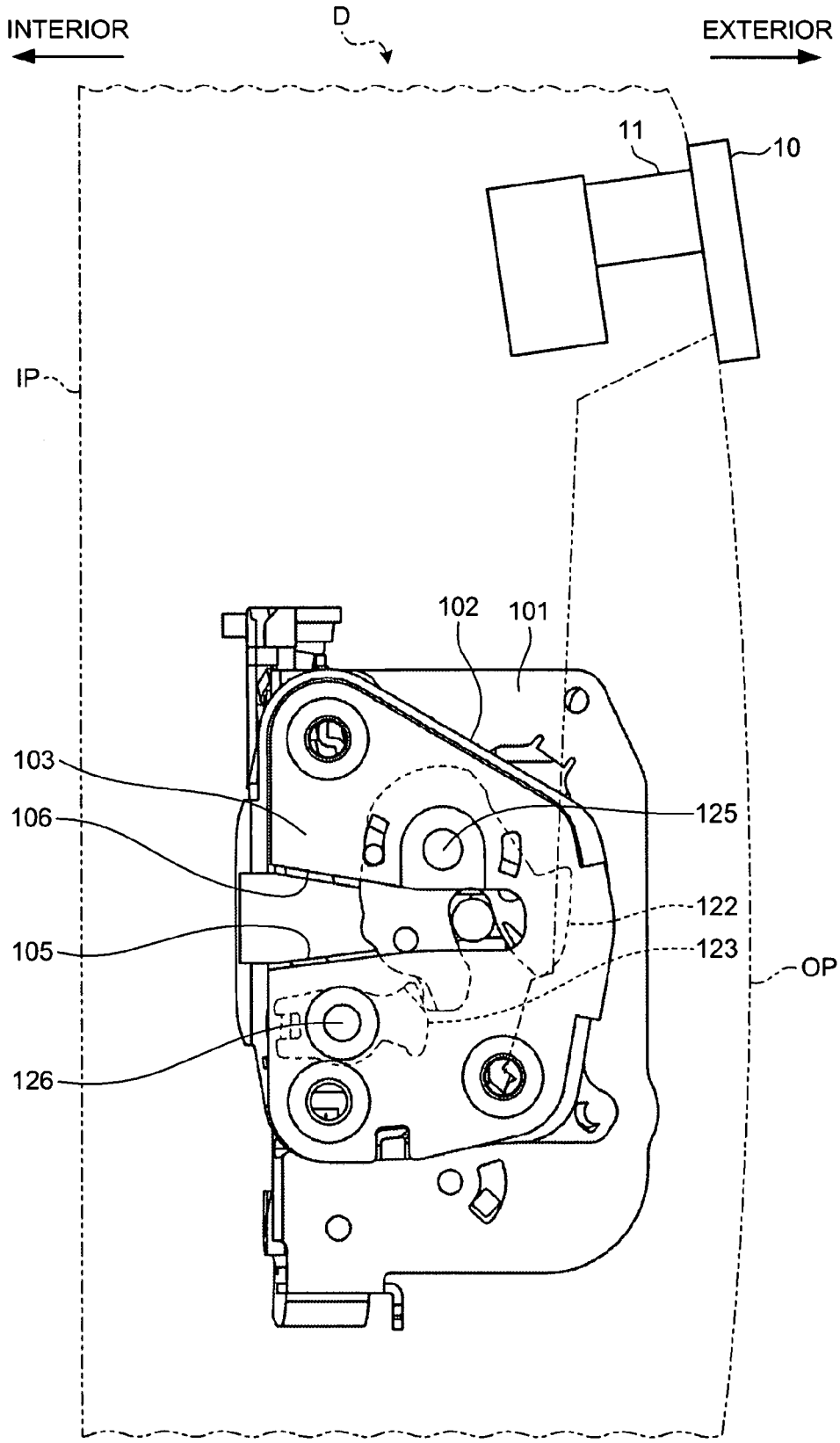
FIG. 27 is a schematic diagram for explaining application of the door lock system shown in FIG. 1 to the vehicle.

As shown in FIG. 27, the door lock system 1 configured as described above is disposed in the side door D between a door outer panel OP on the exterior side of the vehicle and a door inner panel IP on the interior side of the vehicle.

FIGS. 28 to 33 are conceptual diagrams of operations performed by the door lock system 1. With reference to the drawings, the operations of the door lock system 1 will be described below.

Figure 28:
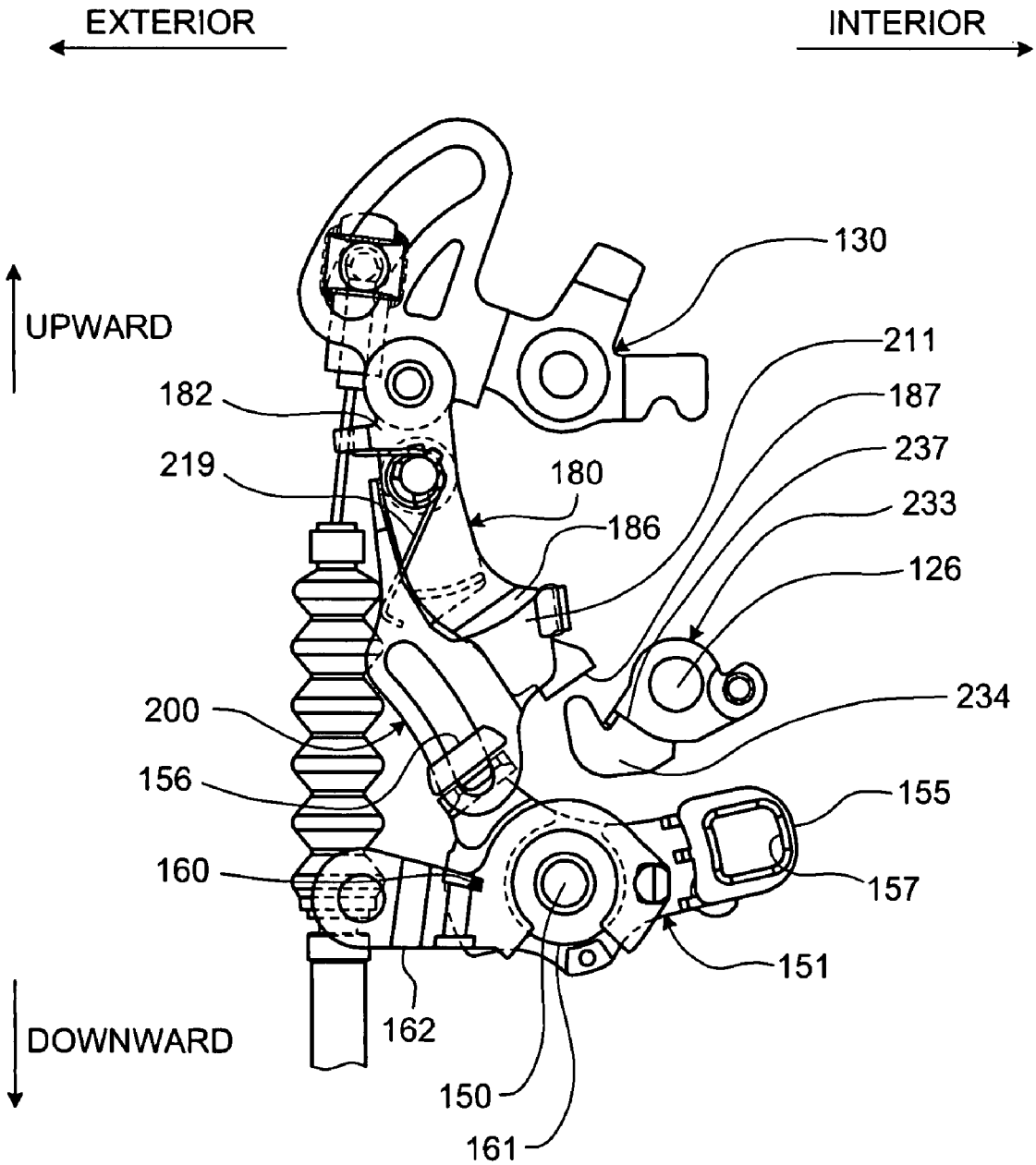
FIG. 28 is a schematic diagram for explaining an initial state of the door lock system shown in FIG. 1.

For convenience, the door lock system 1 in the following state (initial state) will be described: the side door D is closed; as shown in FIG. 28, the handle lever 130 is situated at the non-operable position by the resilient force of the handle lever spring 134; the key lever 160 is at the intermediate position; the first link lever 180 is at the transmitting position; the second link lever 200 is at the third unlocked position; the locking lever 151 is at the unlocked position; and the door lock system 1 is in the unlocked state. When the door lock system is in the unlocked state, the first link lever 180 and the second link lever 200 are in the proximity arrangement in which their distal ends are close to each other in the radial direction of the second-link-lever shaft portion 201.

When, for instance, the outside handle 10 is actuated to open the door in the unlocked state, the operating force exerted for the door-opening operation is transmitted to the handle lever 130 by way of the first connecting member 137. This rotates the handle lever 130 counterclockwise in FIG. 28, and the rotation of the handle lever 130 moves the first link lever 180 downward in FIG. 29.

Figure 29:
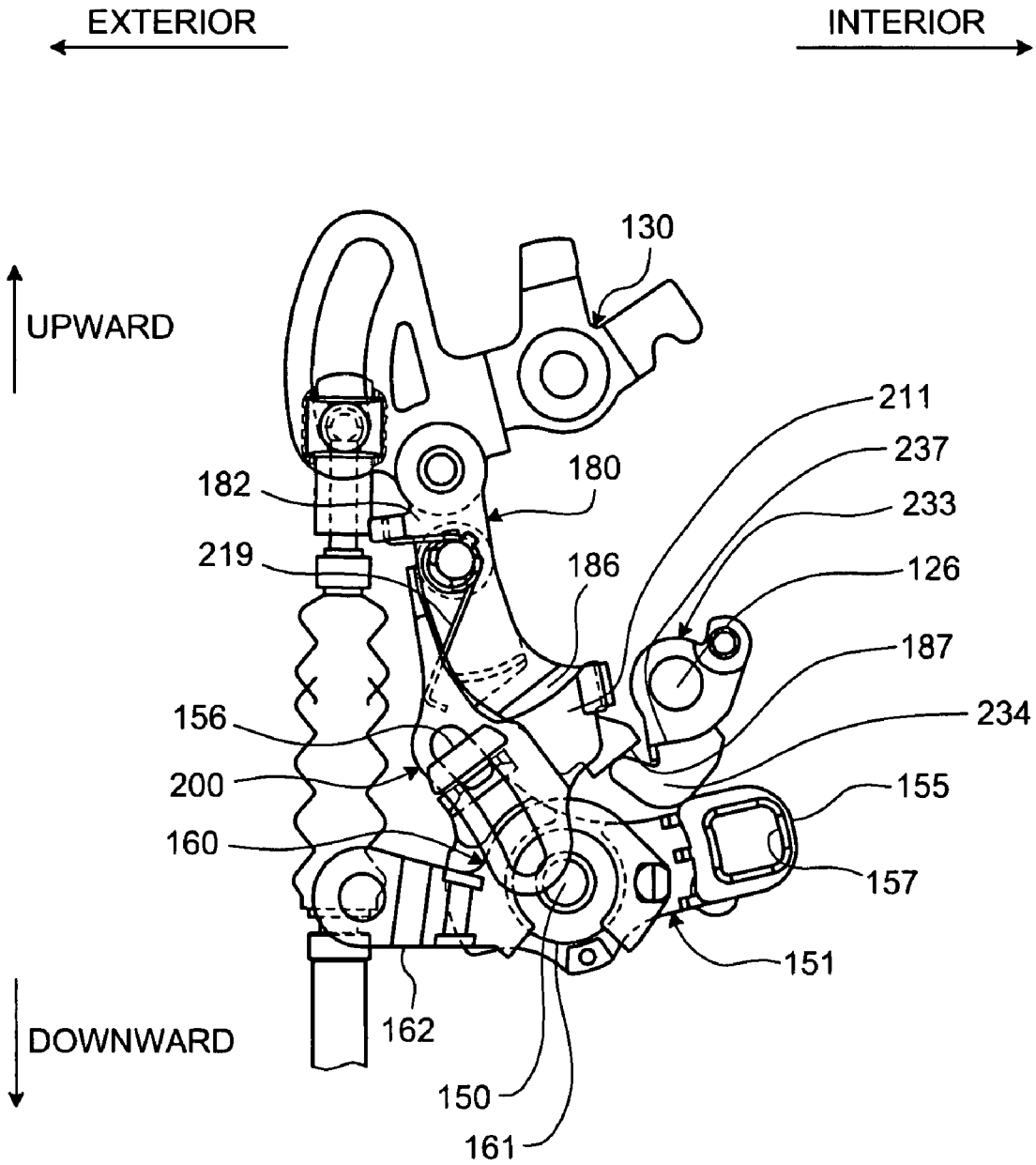
FIG. 29 is a schematic diagram for explaining a state where an outside handle is actuated to open a door of the door lock system shown in FIG. 1.

As shown in FIG. 29, as the first link lever 180 moves downward, the pressing portion 187 on the first link lever 180 presses the pressure-receiving portion 234 of the ratchet lever 233 and rotates the ratchet lever 233 counterclockwise. The counterclockwise rotation of the ratchet lever 233 disengages the hook portion 222 of the latch 122 from the ratchet engaging portion 231 of the ratchet 123. Thus, even when the side door D is closed, the side door D can be moved and opened by pulling the outside handle 10 outward of the vehicle.

When the inside handle 12 is actuated to open the door from the initial state of the door lock system 1 shown in FIG. 28, the operating force exerted for the door-opening operation is transmitted to the handle lever 130 by way of the second connecting member 144 and the inside handle lever 141. This rotates the handle lever 130 counterclockwise in FIG. 28, and the rotation of the handle lever 130 moves the first link lever 180 downward in FIG. 29.

As in the case of actuating the outside handle 10 to open the door, as the first link lever 180 moves downward, the pressing portion 187 on the first link lever 180 presses the pressure-receiving portion 234 of the ratchet lever 233 and rotates the ratchet lever 233 counterclockwise as shown in FIG. 29. The counterclockwise rotation of the ratchet lever 233 disengages the hook portion 222 of the latch 122 from the ratchet engaging portion 231 of the ratchet 123. Thus, even when the side door D is closed, the side door D can be moved and opened by pulling the outside handle 10 outward of the vehicle.

When the door-opening operation is performed in the unlocked state, as shown in, e.g., FIG. 29, the resilient force of the panic spring 219 brings the first link lever 180 and the second link lever 200 into the proximity arrangement in which their distal ends are close to each other in the radial direction of the second-link-lever shaft portion 201. In addition, the base end of the first link lever 180 and that of the second link lever 200 overlap each other, and the distal ends of the same overlap each other.

Figure 30:
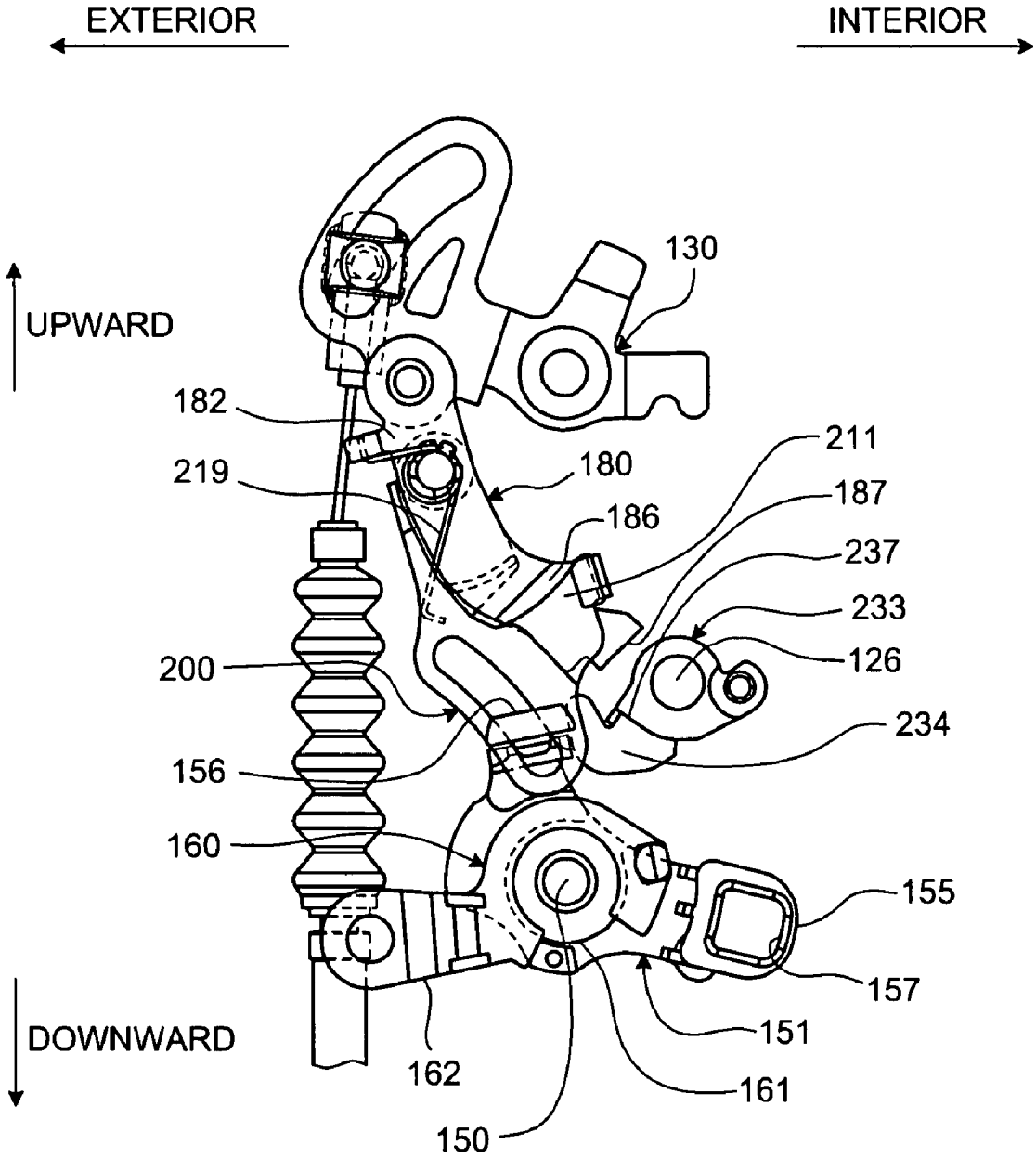
FIG. 30 is a schematic diagram for explaining a locked state of the door lock system shown in FIG. 1.

When the locking operation is performed in the initial state of the door lock system 1 shown in FIG. 28 by, for instance, pressing the sill knob 9, the operating force exerted for the locking operation is transmitted to the locking lever 151 by way of the third connecting member 172 and the rod connecting lever 170. This causes the locking lever 151 to be rotated clockwise and moved from the unlocked position to the locked position as shown in FIG. 30. When the locking lever 151 is rotated and moved from the unlocked position to the locked position, the second link lever 200 is moved to the third locked position and the first link lever 180 is moved to the non-transmitting position. Hence, the door lock system 1 enters the locked state.

Figure 31:
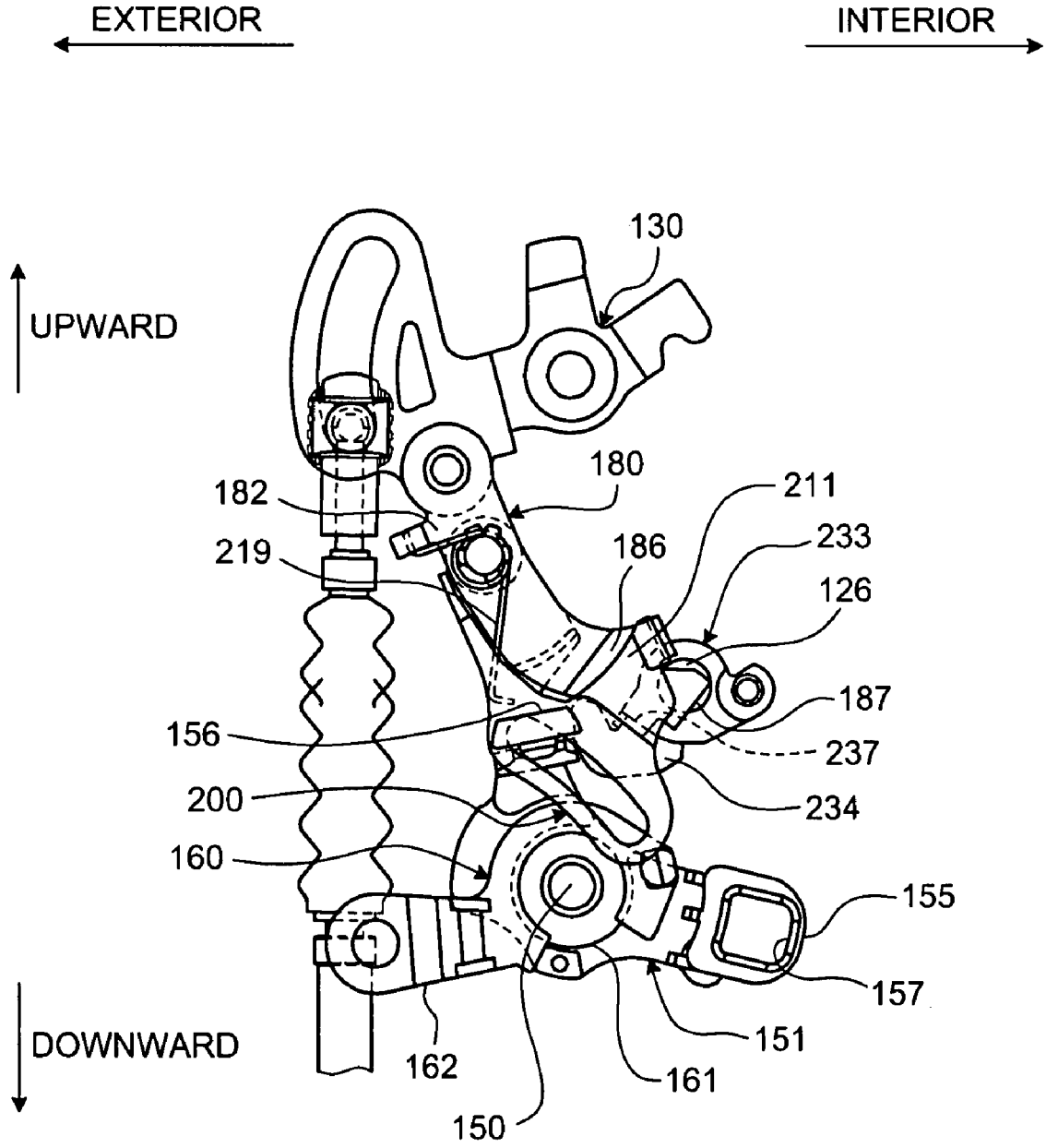
FIG. 31 is a schematic diagram for explaining a state where, in the locked state of the door lock system shown in FIG. 1, the outside handle is actuated to open the door.

When the outside handle 10 or the inside handle 12 is actuated to open the door in the locked state, the door-opening operation moves the first link lever 180 downward as shown in FIG. 31. However, this downward movement of the first link lever 180 does not bring the pressing portion 187 of the first link lever 180 into contact with the pressure-receiving portion 234 of the ratchet lever 233. Accordingly, disengagement of the hook portion 222 of the latch 122 from the ratchet engaging portion 231 of the ratchet 123 is not attained. Hence, for the side door D in the closed state, neither an attempt to move and open the side door D by pulling the outside handle 10 outward of the vehicle nor an attempt to move and open the side door D by pressing the inside handle 12 outward of the vehicle will succeed. Meanwhile, when the unlocking operation is performed in the locked state of the door lock system 1 shown in FIG. 30 by, e.g., pulling the sill knob 9, the locking lever 151 is moved from the locked position to the unlocked position, the second link lever 200 is moved from the third locked position to the third unlocked position, and the first link lever 180 is moved from the non-transmitting position to the transmitting position, thereby bringing the door lock system 1 back to the initial state shown in FIG. 28. Hence, the door lock system 1 enters the unlocked state where the door can be opened using the outside handle 10 or the inside handle 12.

Figure 14:
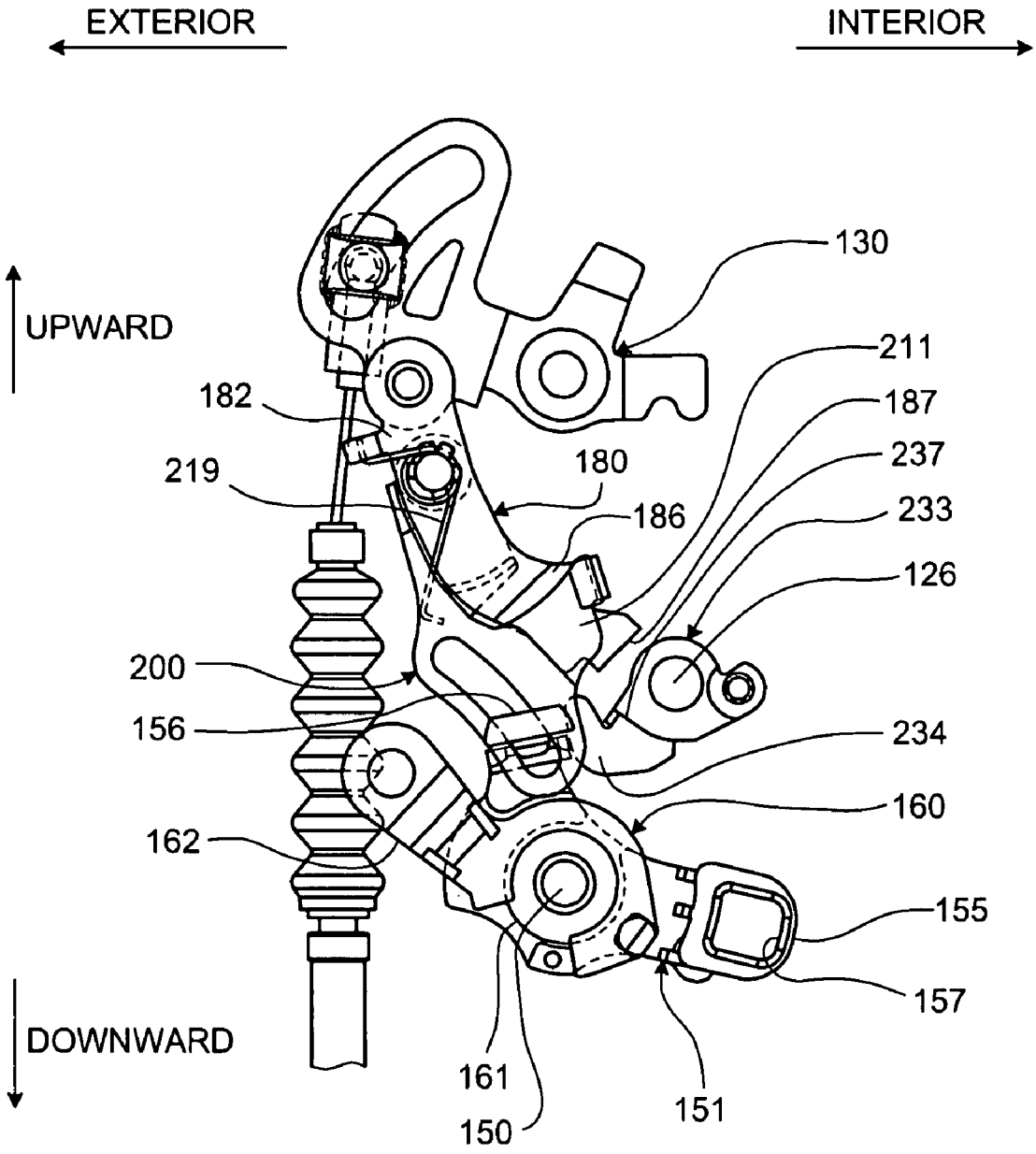
FIG. 14 is a schematic diagram for explaining a second locked position of a key lever in the door lock system shown in FIG. 1.

When the switch at the driver's seat or the switch on the key is operated to drive the actuator in the initial state shown in FIG. 28, the drive force of the actuator is transmitted to the key lever 160 by way of the first arm 251 and the second rod 165. This causes the key lever 160 to be rotated counterclockwise and moved from the intermediate position to the second locked position as shown in FIG. 14. As the key lever 160 rotates, the locking lever 151 is rotated clockwise and moved from the unlocked position to the locked position. When the locking lever 151 is rotated and moved from the unlocked position to the locked position, the second link lever 200 is moved to the third unlocked position and the first link lever 180 is moved to the non-transmitting position. Hence, the door lock system 1 enters the locked state.

Figure 15:
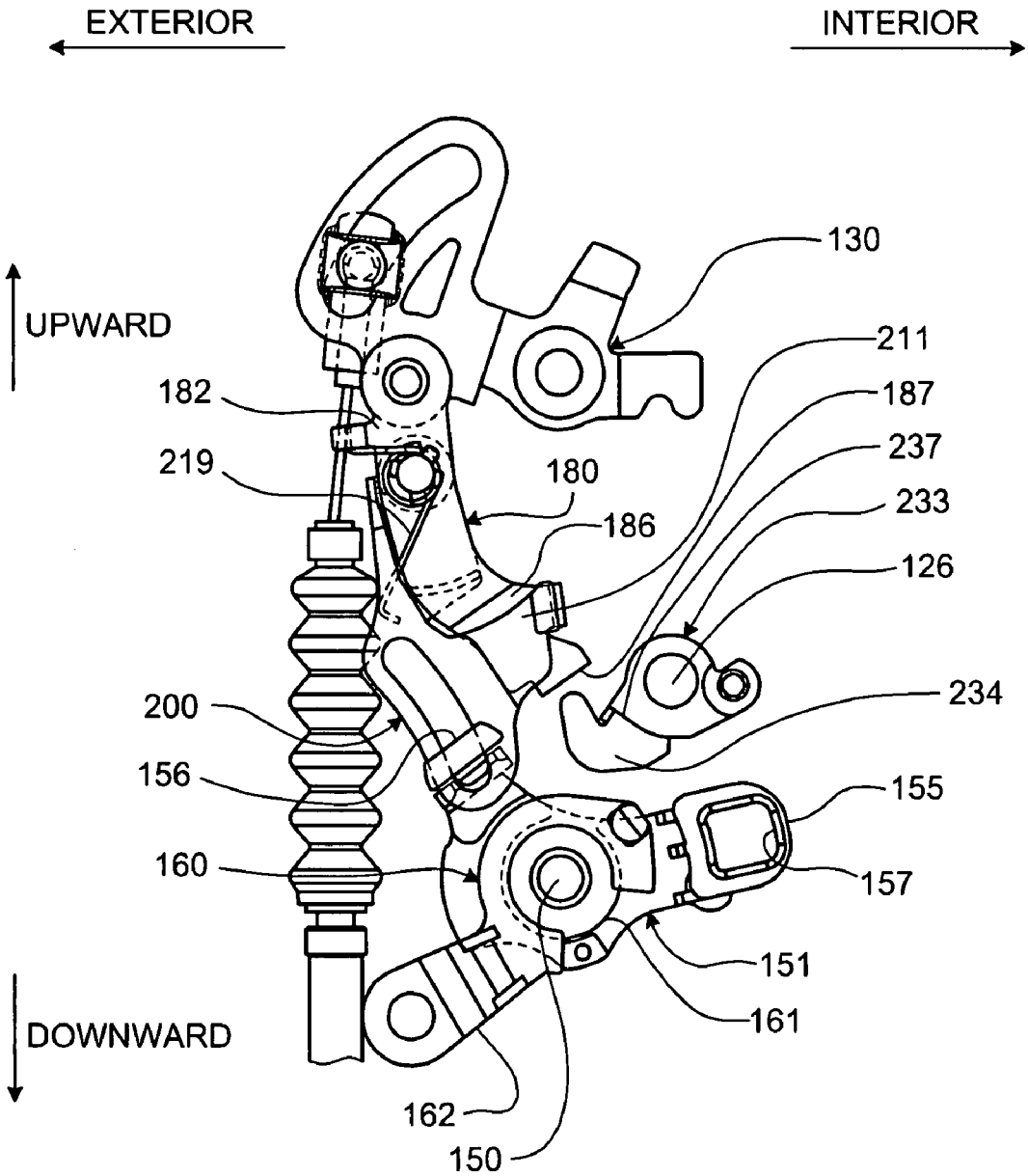
FIG. 15 is a schematic diagram for explaining a second unlocked position of the key lever in the door lock system shown in FIG. 1.

When the outside handle 10 or the inside handle 12 is actuated to open the door in the present locked state, the door-opening operation moves the first link lever 180 downward as shown in FIG. 31. However, the downward movement of the first link lever 180 does not bring the pressing portion 187 of the first link lever 180 into contact with the pressure-receiving portion 234 of the ratchet lever 233. Accordingly, disengagement of the hook portion 222 of the latch 122 from the ratchet engaging portion 231 of the ratchet 123 is not attained. Hence, for the side door D in the closed state, neither an attempt to move and open the side door D by pulling the outside handle 10 outward of the vehicle nor an attempt to move and open the side door D by pressing the inside handle 12 outward of the vehicle will succeed. Meanwhile, when, for instance, the switch at the driver's seat or the switch on the key is operated again to reversely drive the actuator in the locked state shown in FIG. 14, the key lever 160 is moved to the second unlocked position as shown in FIG. 15. The movement of the key lever 160 moves the locking lever 151 from the locked position to the unlocked position, the second link lever 200 from the third locked position to the third unlocked position, and the first link lever 180 from the non-transmitting position to the transmitting position, thereby bringing the door lock system 1 back to the initial state shown in FIG. 28. Hence, the door lock system 1 enters the unlocked state where the door can be opened using the outside handle 10 or the inside handle 12.

When the key cylinder 11 is rotated using the key inserted therein in the initial state shown in FIG. 28, the operating force exerted for rotating the key cylinder 11 is transmitted to the key lever 160 by way of the fourth connecting member 164. This causes the key lever 160 to be rotated counterclockwise and moved from the intermediate position to the second locked position as shown in FIG. 14. As the key lever 160 rotates, the locking lever 151 is rotated clockwise and moved from the unlocked position to the locked position. When the locking lever 151 is rotated and moved from the unlocked position to the locked position, the second link lever 200 is moved to the third unlocked position and the first link lever 180 is moved to the non-transmitting position. Hence, the door lock system 1 enters the locked state.

When the outside handle 10 or the inside handle 12 is actuated to open the door in the present locked state, the door-opening operation moves the first link lever 180 downward as shown in FIG. 31. However, this downward movement of the first link lever 180 does not bring the pressing portion 187 of the first link lever 180 into contact with the pressure-receiving portion 234 of the ratchet lever 233. Accordingly, disengagement of the hook portion 222 of the latch 122 from the ratchet engaging portion 231 of the ratchet 123 is not attained. Hence, for the side door D in the closed state, neither an attempt to move and open the side door D by pulling the outside handle 10 outward of the vehicle nor an attempt to move and open the side door D by pressing the inside handle 12 outward of the vehicle will succeed. Meanwhile, when, for instance, the key cylinder 11 is rotated to unlock the door in the locked state shown in FIG. 14, the key lever 160 is moved to the second unlocked position. The movement of the key lever 160 moves the locking lever 151 from the locked position to the unlocked position, the second link lever 200 from the third locked position to the third unlocked position, and the first link lever 180 from the non-transmitting position to the transmitting position, thereby bringing the door lock system 1 back to the initial state shown in FIG. 28. Hence, the door lock system 1 enters the unlocked state where the door can be opened using the outside handle 10 or the inside handle 12.

In the locked state, as shown in, e.g., FIG. 30, the resilient force of the panic spring 219 brings the first link lever 180 and the second link lever 200 into the proximity arrangement in which their distal ends are close to each other in the radial direction of the second-link-lever shaft portion 201. In addition, the first plate portion 182 of the first link lever 180 and the third plate portion 205 of the second link lever 200 overlap each other, and simultaneously the second plate portion 186 of the first link lever 180 and the fifth plate portion 211 of the second link lever 200 overlap each other. In other words, the base end of the first link lever 180 and that of the second link lever 200 overlap each other, and simultaneously the distal ends of the same overlap each other.

When the door-opening operation is performed in the locked state, as shown in, e.g., FIG. 31, the resilient force of the panic spring 219 brings the first link lever 180 and the second link lever 200 into the proximity arrangement in which their distal ends are close to each other in the radial direction of the second-link-lever shaft portion 201. In addition, the first plate portion 182 of the first link lever 180 and the third plate portion 205 of the second link lever 200 overlap each other, and simultaneously the second plate portion 186 of the first link lever 180 and the fifth plate portion 211 of the second link lever 200 overlap each other. In other words, the base end of the first link lever 180 and that of the second link lever 200 overlap each other, and simultaneously the distal ends of the same overlap each other.

Unlocking the door in the locked state shown in FIG. 30 using the sill knob 9 while simultaneously actuating the outside handle 10 to open the door will be described below.

Figure 32:
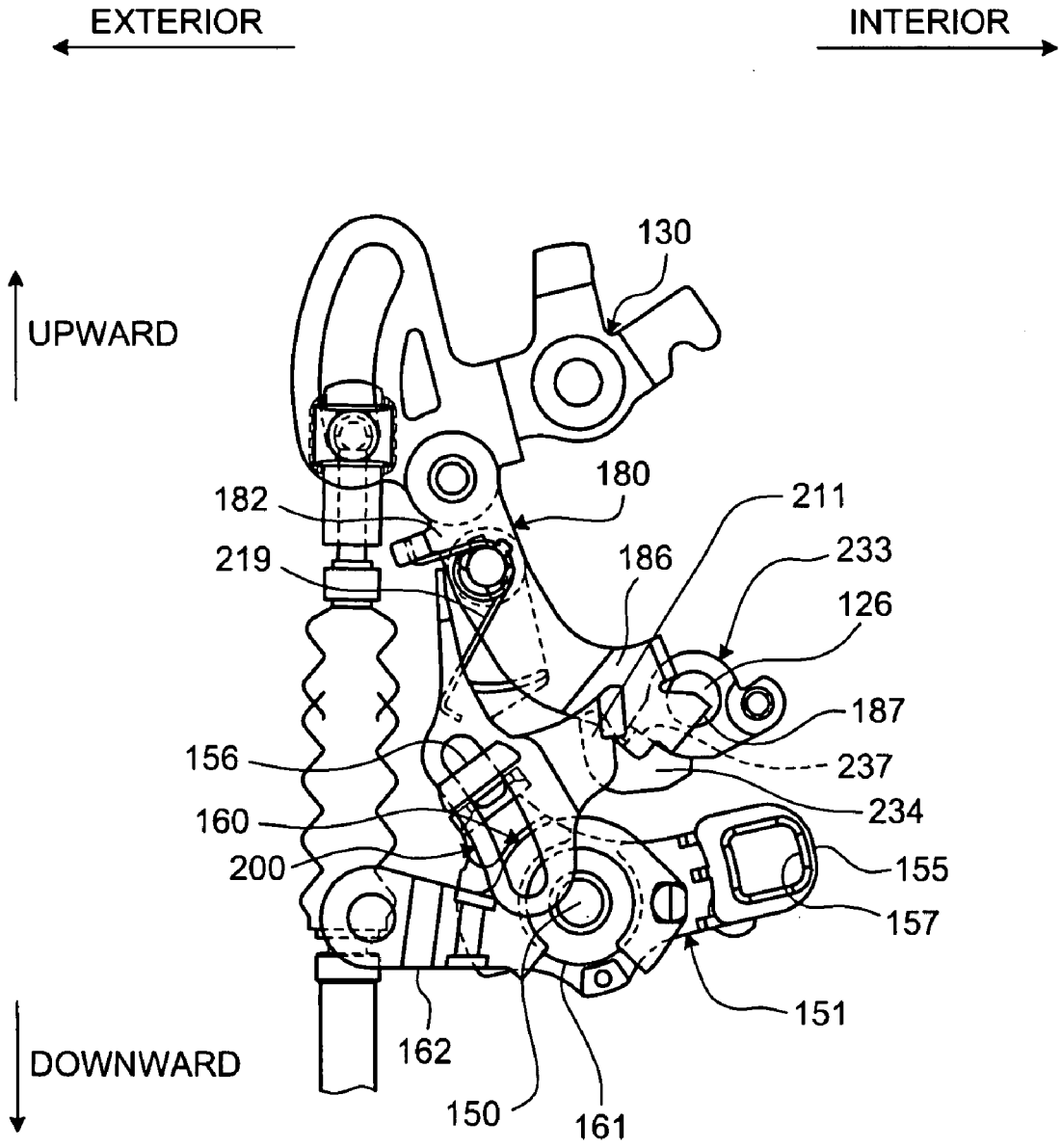
FIG. 32 is a schematic diagram for explaining a state where, in the locked state of the door lock system shown in FIG. 1, the outside handle is actuated to open the door and a sill knob is operated to unlock the door.

When, for instance, the outside handle 10 is actuated to open the door prior to the unlocking operation, only the first link lever 180 and the second link lever 200 are moved without bringing the pressing portion 187 of the first link lever 180 into contact with the pressure-receiving portion 234 of the ratchet lever 233 as shown in FIG. 31. When the sill knob 9 is operated to unlock the door in such a state, the locking lever 151 is rotated from the locked position to the unlocked position as shown in FIG. 32. In the course of the rotation of the locking lever 151, the pressing portion 187 is caught by the pressure-receiving wall 237 of the pressure-receiving portion 234 of the of the ratchet lever 233, which causes the first link lever 180 to stay. On the other hand, the second link lever 200 is moved from the third locked position to the third unlocked position in response to the rotation of the locking lever 151. As shown in FIG. 32, the movement of the second link lever 200 brings the first link lever 180 and the second link lever 200 into a separated arrangement in which their distal ends are away from each other in the radial direction with respect to the center axis 201*x* of the second-link-lever shaft portion 201. Also in this state, the first plate portion 182 of the first link lever 180 and the third plate portion 205 of the second link lever 200 overlap each other, and simultaneously the second plate portion 186 of the first link lever 180 and the fifth plate portion 211 of the second link lever 200 overlap each other. In other words, the base end of the first link lever 180 and that of the second link lever 200 overlap each other, and simultaneously the distal ends of the same overlap each other.

Figure 33:
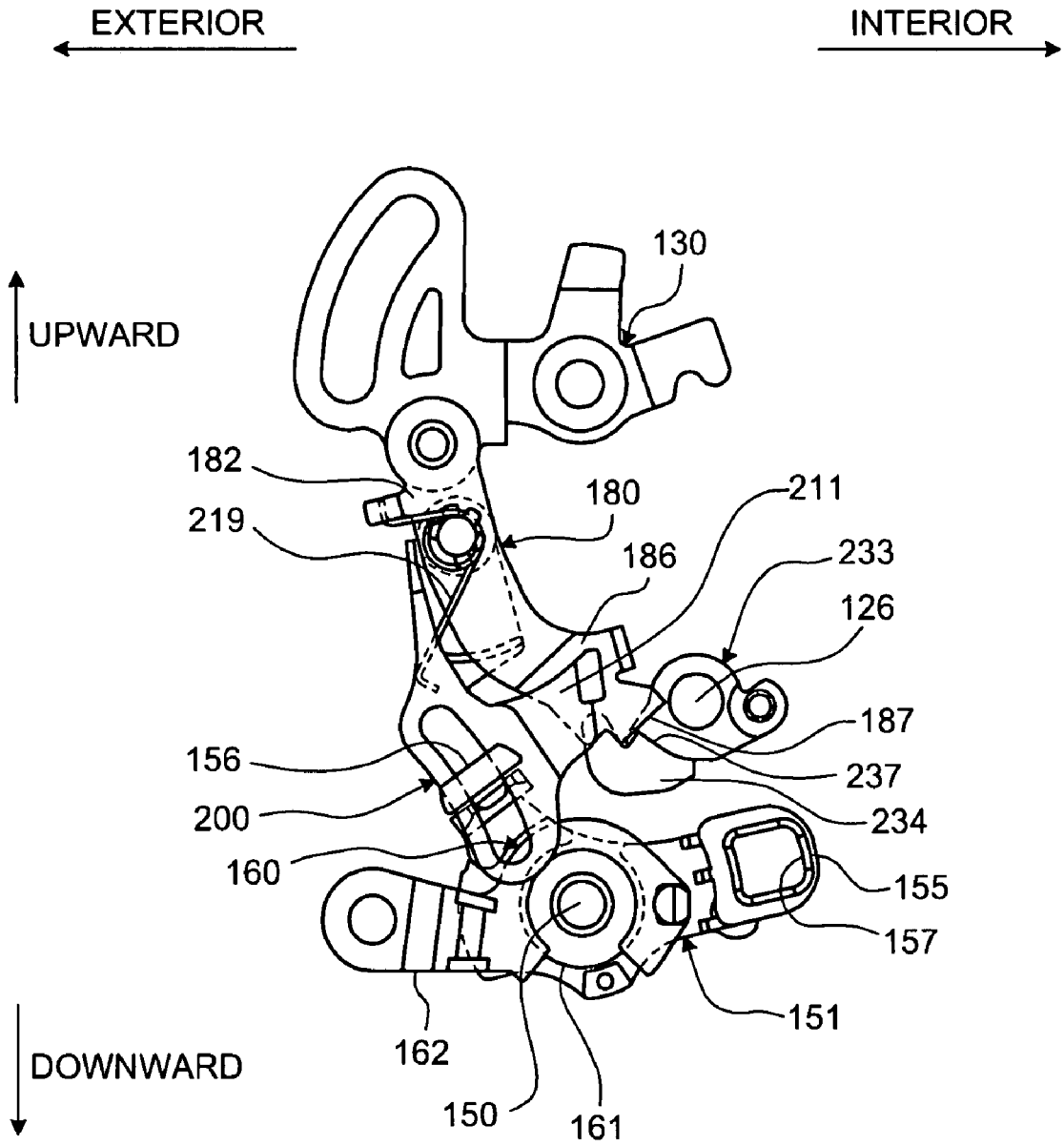
FIG. 33 is another schematic diagram for explaining a state where, in the locked state of the door lock system shown in FIG. 1, the outside handle is actuated to open the door and a sill knob is operated to unlock the door.

When thereafter the door-opening operation using the outside handle 10 is stopped to rotate the handle lever 130 from the operable position to the non-operable position, the movement of the second link lever 200 to the third unlocked position is transmitted to the first link lever 180 by the resilient force of the panic spring 219. This moves the first link lever 180 with the pressing portion 187 being in contact with the pressure-receiving wall 237 of the pressure-receiving portion 234 as shown in FIG. 33. When the exterior side of the first link lever 180 comes into contact with the second step 208, the movement of the first link lever 180 is stopped, thereby bringing the first link lever 180 into the proximity arrangement and to the transmitting position. Thus, the door lock system 1 enters the unlocked state.

When the door-opening operation using the outside handle 10 is performed in the present state, the latch 122 is successfully disengaged from the ratchet 123, thereby allowing the side door D to be moved and opened. Thus, according to the door lock system 1, when the unlocking operation using the sill knob 9 is performed in the locked state while the door-opening operation using the outside handle 10 is performed, the need of operating the sill knob 9 twice to unlock the door is eliminated, thereby reducing the number of operations.

As described above, according to the door lock system 1, in any state, the first plate portion 182 of the first link lever 180 and the third plate portion 205 of the second link lever 200 overlap each other, and simultaneously the second plate portion 186 of the first link lever 180 and the fifth plate portion 211 of the second link lever 200 overlap each other. The overlapping of the first link lever 180 and the second link lever 200 yields the following effects. When the first link lever 180 is urged to move forward of the vehicle, the second plate portion 186 of the first link lever 180 comes into contact with the fifth plate portion 211 of the second link lever 200, which constantly restricts forward movement of the first link lever 180. When the first link lever 180 is urged to move rearward of the vehicle, the first plate portion 182 of the first link lever 180 comes into contact with the third plate portion 205 of the second link lever 200, which constantly restricts rearward movement of the first link lever 180. Accordingly, the first link lever 180 and the second link lever 200 are prevented from being moved away from each other in the axial direction of the second-link-lever shaft portion 201. Hence, a change in positional relationship between the distal end of the first link lever 180 and the distal end of the second link lever 200 in the axial direction of the second-link-lever shaft portion 201 is prevented.

The present embodiment has described the configuration in which the second link lever 200 includes the fifth plate portion 211 corresponding to the overlapping portion. However, the present invention is not limited thereto, and the same effect yielded by the configuration can be obtained by providing the overlapping portion on the first link lever 180 and interposing the second link lever 200 between the overlapping portion and the base end of the first link lever 180.

The embodiment has described the example in which, in the locked state of the door lock system 1, the outside handle 10 is actuated to open the door while the sill knob 9 is operated to unlock the door. However, the present invention is not limited thereto, and the same effect is also yielded by actuating the inside handle 12 to open the door while operating the switch on the key to unlock the door from outside of the vehicle, operating the switch at the driver's seat to unlock the door, or inserting the key into the key cylinder 11 and rotating the key cylinder 11 to unlock the door in the door lock system 1 in the locked state. As is apparent, combinations of the operations are not limited thereto, and the same effect as that yielded in the embodiment is obtained by performing a door-opening operation while performing an unlocking operation in the door lock system 1 in the locked state.

The door lock system according to the present invention allows to prevent a change in positional relationship between distal ends of two link levers.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2006-271106, filed Oct. 2, 2006, which is incorporated herein by reference in its entirety.

What is claimed is:

1. A door lock system comprising:

a ratchet;

a latch;

a ratchet lever that integrally rotates with the ratchet and includes a pressure-receiving portion;

a handle lever that is rotatably disposed at a rotational axis and is connected with an outside handle;

a locking lever that is rotatably disposed on a locking lever shaft and includes a first engaging pin;

a first link lever that is rotatably disposed and connected with the handle lever at a first-link-lever shaft hole and includes a pressing portion; and a second link lever that is connected to the locking lever by slidably housing the first engaging pin in a second slide slot, and that is connected to the first link lever by inserting a second-link-lever shaft portion into a shaft insertion hole; and a panic spring that is interposed between the first link lever and the second link lever, wherein the panic spring transmits, when an unlocking operation is performed, a motion of the second link lever to the first link lever using a resilient force of the panic spring to move the first link lever to a transmitting position, wherein the pressure-receiving portion and the pressing portion are positioned to face each other so as to abut and press the pressure-receiving portion with the pressing portion when the handle lever is rotated for opening action and the first link lever is moved down if the locking lever is in an unlock position, wherein the first link lever is configured to be rotated via the second link lever accompanied by the locking lever rotation to a lock position so as to move the pressing portion away from the pressure-receiving portion, and a distal end of the first link lever and a distal end of the second link lever constantly overlap each other in a radial direction of the second link lever.

2. The door lock system according to claim 1, wherein an overlapping portion is provided on at least one of the first and second link levers so as to extend toward the distal end of the other one of the first and second link levers such that the other link lever is interposed between a base end of the one link lever and the overlapping portion.

3. The door lock system according to claim 1, wherein the first and second link levers constantly overlap each other with a first surface of one link lever opposing a second surface of the other link lever, and with a second surface of the one link lever opposing a first surface of the other link lever.

4. The door lock system according to claim 3, wherein the first and second link levers constantly overlap each other with the first surface of the one link lever opposing the second surface of the other link lever on the base ends of the link levers, and with the second surface of the one link lever opposing the first surface of the other link lever on the distal ends of the link levers.

* * * * *